US006024430A

United States Patent [19]

Koitabashi et al.

[11] Patent Number: 6,024,430

[45] Date of Patent: Feb. 15, 2000

[54] RECORDING METHOD AND APPARATUS FOR PRESUMING CHARACTERISTICS OF TEMPERATURE SENSORS

[75] Inventors: Noribumi Koitabashi; Hiromitsu Hirabayashi, both of Yokohama; Shigeyasu Nagoshi, Kawasaki; Hitoshi Sugimoto, Yokohama; Miyuki Matsubara, Tokyo; Hitoshi Nishikori; Masaya Uetuki, both of Kawasaki, all of Japan

[73] Assignee: Canon Kabushiki Kaisha, Tokyo, Japan

[21] Appl. No.: 08/813,303

[22] Filed: Mar. 10, 1997

Related U.S. Application Data

[63] Continuation of application No. 08/249,850, May 26, 1994, abandoned.

[30] Foreign Application Priority Data

May 27, 1993 [JP] Japan ..... 5-126395

[51] Int. Cl.[7] ..... B41J 2/01

[52] U.S. Cl. ..... 347/17; 347/19

[58] Field of Search ..... 347/14, 17, 19, 347/49, 85–87

[56] References Cited

U.S. PATENT DOCUMENTS

| | | | |
|---|---|---|---|
| 3,880,006 | 4/1975 | Poduje | 374/173 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 5,289,210 | 2/1994 | Takayanagi | 347/14 |
| 5,361,090 | 11/1994 | Suzuki et al. | 347/17 |
| 5,365,257 | 11/1994 | Minowa et al. | 347/189 |

FOREIGN PATENT DOCUMENTS

| | | |
|---|---|---|
| 0451778 | 10/1991 | European Pat. Off. . |
| 0526223 | 2/1993 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 05031906 | 2/1993 | Japan . |
| 05031918 | 2/1993 | Japan . |
| 05064890 | 3/1993 | Japan . |

*Primary Examiner*—John Barlow
*Assistant Examiner*—Craig A. Hallacher
*Attorney, Agent, or Firm*—Fitzpatrick, Cella, Harper & Scinto

[57] ABSTRACT

An ink jet recording apparatus can obtain characteristics of temperature sensors precisely in a short time by detecting that a new recording head is installed and presuming the characteristics of the temperature sensors of the recording head.

44 Claims, 28 Drawing Sheets

FIG. 3

| RANK | 1 | 2 | 3 | 4 | 5 | 6 | 7 | 8 | 9 | 10 | 11 | 12 | 13 |
|---|---|---|---|---|---|---|---|---|---|---|---|---|---|
| R(Ω) | 225.3 ~ 233.1 | 233.1 ~ 240.9 | 240.9 ~ 248.7 | 248.7 ~ 256.5 | 256.5 ~ 264.3 | 264.3 ~ 272.1 | 272.1 ~ 279.9 | 279.9 ~ 287.7 | 287.7 ~ 295.5 | 295.5 ~ 303.3 | 303.3 ~ 311.1 | 311.1 ~ 318.9 | 318.9 ~ 326.7 |

$P_1$ : PRE-PULSE ($=T_1$) (PWM)
$P_2$ : INTERVAL ($=T_2-T_1$)
$P_3$ : MAIN PULSE ($=T_3-T_2$)
Vop : OPERATIONAL VOLTAGE

FIG. 18

| AMBIENT TEMP | TARGET TEMP | AMBIENT TEMP | TARGET TEMP | AMBIENT TEMP | TARGET TEMP | AMBIENT TEMP | TARGET TEMP |
|---|---|---|---|---|---|---|---|
| 0.0 ℃ | 35.5 ℃ | 17.5 ℃ | 26.0 ℃ | 35.0 ℃ | 15.0 ℃ | 52.5 ℃ | 15.0 ℃ |
| 0.5 ℃ | 35.5 ℃ | 18.0 ℃ | 26.0 ℃ | 35.5 ℃ | 15.0 ℃ | 53.0 ℃ | 15.0 ℃ |
| 1.0 ℃ | 35.5 ℃ | 18.5 ℃ | 25.5 ℃ | 36.0 ℃ | 15.0 ℃ | 53.5 ℃ | 15.0 ℃ |
| 1.5 ℃ | 35.5 ℃ | 19.0 ℃ | 25.5 ℃ | 36.5 ℃ | 15.0 ℃ | 54.0 ℃ | 15.0 ℃ |
| 2.0 ℃ | 35.5 ℃ | 19.5 ℃ | 25.0 ℃ | 37.0 ℃ | 15.0 ℃ | 54.5 ℃ | 15.0 ℃ |
| 2.5 ℃ | 35.5 ℃ | 20.0 ℃ | 24.5 ℃ | 37.5 ℃ | 15.0 ℃ | 55.0 ℃ | 15.0 ℃ |
| 3.0 ℃ | 35.5 ℃ | 20.5 ℃ | 24.5 ℃ | 38.0 ℃ | 15.0 ℃ | 55.5 ℃ | 15.0 ℃ |
| 3.5 ℃ | 35.5 ℃ | 21.0 ℃ | 24.0 ℃ | 38.5 ℃ | 15.0 ℃ | 56.0 ℃ | 15.0 ℃ |
| 4.0 ℃ | 35.5 ℃ | 21.5 ℃ | 24.0 ℃ | 39.0 ℃ | 15.0 ℃ | 56.5 ℃ | 15.0 ℃ |
| 4.5 ℃ | 35.5 ℃ | 22.0 ℃ | 23.5 ℃ | 39.5 ℃ | 15.0 ℃ | 57.0 ℃ | 15.0 ℃ |
| 5.0 ℃ | 35.5 ℃ | 22.5 ℃ | 23.5 ℃ | 40.0 ℃ | 15.0 ℃ | 57.5 ℃ | 15.0 ℃ |
| 5.5 ℃ | 35.0 ℃ | 23.0 ℃ | 23.0 ℃ | 40.5 ℃ | 15.0 ℃ | 58.0 ℃ | 15.0 ℃ |
| 6.0 ℃ | 34.5 ℃ | 23.5 ℃ | 22.5 ℃ | 41.0 ℃ | 15.0 ℃ | 58.5 ℃ | 15.0 ℃ |
| 6.5 ℃ | 34.0 ℃ | 24.0 ℃ | 22.5 ℃ | 41.5 ℃ | 15.0 ℃ | 59.0 ℃ | 15.0 ℃ |
| 7.0 ℃ | 34.0 ℃ | 24.5 ℃ | 22.0 ℃ | 42.0 ℃ | 15.0 ℃ | 59.5 ℃ | 15.0 ℃ |
| 7.5 ℃ | 33.5 ℃ | 25.0 ℃ | 21.5 ℃ | 42.5 ℃ | 15.0 ℃ | 60.0 ℃ | 15.0 ℃ |
| 8.0 ℃ | 33.0 ℃ | 25.5 ℃ | 21.5 ℃ | 43.0 ℃ | 15.0 ℃ | 60.5 ℃ | 15.0 ℃ |
| 8.5 ℃ | 32.5 ℃ | 26.0 ℃ | 21.0 ℃ | 43.5 ℃ | 15.0 ℃ | 61.0 ℃ | 15.0 ℃ |
| 9.0 ℃ | 32.0 ℃ | 26.5 ℃ | 20.5 ℃ | 44.0 ℃ | 15.0 ℃ | 61.5 ℃ | 15.0 ℃ |
| 9.5 ℃ | 32.0 ℃ | 27.0 ℃ | 20.5 ℃ | 44.5 ℃ | 15.0 ℃ | 62.0 ℃ | 15.0 ℃ |
| 10.0 ℃ | 31.5 ℃ | 27.5 ℃ | 20.0 ℃ | 45.0 ℃ | 15.0 ℃ | 62.5 ℃ | 15.0 ℃ |
| 10.5 ℃ | 31.0 ℃ | 28.0 ℃ | 19.5 ℃ | 45.5 ℃ | 15.0 ℃ | 63.0 ℃ | 15.0 ℃ |
| 11.0 ℃ | 30.5 ℃ | 28.5 ℃ | 19.0 ℃ | 46.0 ℃ | 15.0 ℃ | 63.5 ℃ | 15.0 ℃ |
| 11.5 ℃ | 30.5 ℃ | 29.0 ℃ | 19.0 ℃ | 46.5 ℃ | 15.0 ℃ | 64.0 ℃ | 15.0 ℃ |
| 12.0 ℃ | 30.0 ℃ | 29.5 ℃ | 18.5 ℃ | 47.0 ℃ | 15.0 ℃ | 64.5 ℃ | 15.0 ℃ |
| 12.5 ℃ | 29.5 ℃ | 30.0 ℃ | 18.0 ℃ | 47.5 ℃ | 15.0 ℃ | 65.0 ℃ | 15.0 ℃ |
| 13.0 ℃ | 29.0 ℃ | 30.5 ℃ | 18.0 ℃ | 48.0 ℃ | 15.0 ℃ | 65.5 ℃ | 15.0 ℃ |
| 13.5 ℃ | 28.5 ℃ | 31.0 ℃ | 17.5 ℃ | 48.5 ℃ | 15.0 ℃ | 66.0 ℃ | 15.0 ℃ |
| 14.0 ℃ | 28.5 ℃ | 31.5 ℃ | 17.0 ℃ | 49.0 ℃ | 15.0 ℃ | 66.5 ℃ | 15.0 ℃ |
| 14.5 ℃ | 28.0 ℃ | 32.0 ℃ | 17.0 ℃ | 49.5 ℃ | 15.0 ℃ | 67.0 ℃ | 15.0 ℃ |
| 15.0 ℃ | 27.5 ℃ | 32.5 ℃ | 16.5 ℃ | 50.0 ℃ | 15.0 ℃ | 67.5 ℃ | 15.0 ℃ |
| 15.5 ℃ | 27.0 ℃ | 33.0 ℃ | 16.0 ℃ | 50.5 ℃ | 15.0 ℃ | 68.0 ℃ | 15.0 ℃ |
| 16.0 ℃ | 27.0 ℃ | 33.5 ℃ | 16.0 ℃ | 51.0 ℃ | 15.0 ℃ | 68.5 ℃ | 15.0 ℃ |
| 16.5 ℃ | 26.5 ℃ | 34.0 ℃ | 15.5 ℃ | 51.5 ℃ | 15.0 ℃ | 69.0 ℃ | 15.0 ℃ |
| 17.0 ℃ | 26.5 ℃ | 34.5 ℃ | 15.0 ℃ | 52.0 ℃ | 15.0 ℃ | 69.5 ℃ | 15.0 ℃ |

a : EQUILIBRIUM TEMP
Δt : INCREASED TEMP

FIG. 21

| HEAT SOURCE / THERMAL TIME CONSTANT | EJECTION HEATER | | SUB-HEATER | |
|---|---|---|---|---|
| | SHORT | LONG | SHORT | LONG |
| REQUIRED CALCULATION INTERVAL | 0.05sec | 1.00sec | 0.05sec | 1.00sec |
| DATA HOLD TIME | 0.80sec | 512sec | 0.80sec | 512sec |

FIG. 22

| | 0.0% ~ | 2.5% ~ | 5.0% ~ | 7.5% ~ | 10.0% ~ | 12.5% ~ | 87.5% ~ | 90.0% ~ | 92.5% ~ | 95.0% ~ | 97.5% ~ |
|---|---|---|---|---|---|---|---|---|---|---|---|
| 0.05sec~ | 0.00 | 0.89 | 1.56 | 2.22 | 2.89 | 3.66 | 14.11 | 14.21 | 14.32 | 14.42 | 14.53 |
| 0.10sec~ | 0.00 | 0.43 | 0.62 | 0.41 | 1.01 | 1.24 | 4.89 | 4.93 | 4.97 | 5.00 | 5.04 |
| 0.15sec~ | 0.00 | 0.20 | 0.25 | 0.30 | 0.35 | 0.42 | 1.70 | 1.71 | 1.72 | 1.74 | 1.75 |
| 0.20sec~ | 0.00 | 0.09 | 0.10 | 0.11 | 0.12 | 0.14 | 0.59 | 0.59 | 0.60 | 0.60 | 0.61 |
| 0.25sec~ | 0.00 | 0.04 | 0.05 | 0.07 | 0.08 | 0.09 | 0.17 | 0.17 | 0.17 | 0.17 | 0.17 |
| 0.30sec~ | 0.00 | 0.04 | 0.05 | 0.07 | 0.08 | 0.09 | 0.17 | 0.17 | 0.17 | 0.17 | 0.17 |
| 0.35sec~ | 0.00 | 0.04 | 0.05 | 0.07 | 0.08 | 0.09 | 0.17 | 0.17 | 0.17 | 0.17 | 0.17 |
| 0.40sec~ | 0.00 | 0.04 | 0.05 | 0.07 | 0.08 | 0.09 | 0.17 | 0.17 | 0.17 | 0.17 | 0.17 |
| 0.45sec~ | 0.00 | 0.04 | 0.05 | 0.07 | 0.08 | 0.09 | 0.17 | 0.17 | 0.17 | 0.17 | 0.17 |
| 0.50sec~ | 0.00 | 0.04 | 0.05 | 0.07 | 0.08 | 0.09 | 0.17 | 0.17 | 0.17 | 0.17 | 0.17 |
| 0.55sec~ | 0.00 | 0.04 | 0.05 | 0.07 | 0.08 | 0.09 | 0.17 | 0.17 | 0.17 | 0.17 | 0.17 |
| 0.60sec~ | 0.00 | 0.04 | 0.05 | 0.07 | 0.08 | 0.09 | 0.17 | 0.17 | 0.17 | 0.17 | 0.17 |
| 0.65sec~ | 0.00 | 0.04 | 0.05 | 0.07 | 0.08 | 0.09 | 0.17 | 0.17 | 0.17 | 0.17 | 0.17 |
| 0.70sec~ | 0.00 | 0.04 | 0.05 | 0.07 | 0.08 | 0.09 | 0.17 | 0.17 | 0.17 | 0.17 | 0.17 |
| 0.75sec~ | 0.00 | 0.04 | 0.05 | 0.07 | 0.08 | 0.09 | 0.17 | 0.17 | 0.17 | 0.17 | 0.17 |
| 0.80sec~ | 0.00 | 0.04 | 0.05 | 0.07 | 0.08 | 0.09 | 0.17 | 0.17 | 0.17 | 0.17 | 0.17 |
| 0.85sec~ | 0.00 | 0.00 | 0.00 | 0.00 | 0.00 | 0.00 | 0.00 | 0.00 | 0.00 | 0.00 | 0.00 |

FIG. 23

| | 0.0% ~ | 2.5% ~ | 5.0% ~ | 7.5% ~ | 10.0% ~ | 12.5% ~ | 87.5% ~ | 90.0% ~ | 92.5% ~ | 95.0% ~ | 97.5% ~ |
|---|---|---|---|---|---|---|---|---|---|---|---|
| 1sec ~ | 0.00 | 0.15 | 0.27 | 0.39 | 0.52 | 0.62 | 2.65 | 2.68 | 2.75 | 2.75 | 2.79 |
| 3sec ~ | 0.00 | 0.08 | 0.16 | 0.24 | 0.32 | 0.37 | 0.79 | 0.80 | 0.81 | 0.81 | 0.82 |
| 5sec ~ | 0.00 | 0.07 | 0.09 | 0.11 | 0.13 | 0.17 | 0.48 | 0.49 | 0.49 | 0.50 | 0.50 |
| 7sec ~ | 0.00 | 0.12 | 0.14 | 0.16 | 0.18 | 0.20 | 0.70 | 0.70 | 0.71 | 0.71 | 0.72 |
| 9sec ~ | 0.00 | 0.06 | 0.11 | 0.15 | 0.20 | 0.22 | 0.43 | 0.43 | 0.43 | 0.44 | 0.44 |
| 11sec ~ | 0.00 | 0.05 | 0.07 | 0.09 | 0.11 | 0.13 | 0.38 | 0.39 | 0.39 | 0.39 | 0.40 |
| 21sec ~ | 0.00 | 0.04 | 0.05 | 0.06 | 0.07 | 0.08 | 0.17 | 0.17 | 0.17 | 0.17 | 0.17 |
| 41sec ~ | 0.00 | 0.03 | 0.04 | 0.05 | 0.06 | 0.06 | 0.17 | 0.17 | 0.17 | 0.17 | 0.17 |
| 61sec ~ | 0.00 | 0.02 | 0.03 | 0.04 | 0.05 | 0.05 | 0.10 | 0.10 | 0.10 | 0.11 | 0.11 |
| 81sec ~ | 0.00 | 0.01 | 0.02 | 0.03 | 0.04 | 0.04 | 0.06 | 0.06 | 0.06 | 0.06 | 0.06 |
| 101sec ~ | 0.00 | 0.02 | 0.02 | 0.02 | 0.03 | 0.03 | 0.06 | 0.06 | 0.06 | 0.06 | 0.06 |
| 151sec ~ | 0.00 | 0.01 | 0.01 | 0.01 | 0.02 | 0.02 | 0.03 | 0.03 | 0.03 | 0.03 | 0.03 |
| 301sec ~ | 0.00 | 0.01 | 0.01 | 0.01 | 0.01 | 0.01 | 0.02 | 0.02 | 0.02 | 0.02 | 0.02 |
| 512sec ~ | 0.00 | 0.00 | 0.00 | 0.00 | 0.00 | 0.00 | 0.00 | 0.00 | 0.00 | 0.00 | 0.00 |

FIG. 24

| | 0.0% ~ | 20.0% ~ | 40.0% ~ | 60.0% ~ | 80.0% ~ |
|---|---|---|---|---|---|
| 0.05sec~ | 3.57 | 7.00 | 6.26 | 10.10 | 11.64 |
| 0.10sec~ | 2.25 | 4.20 | 4.10 | 6.24 | 7.16 |
| 0.15sec~ | 1.45 | 2.52 | 2.69 | 3.85 | 4.40 |
| 0.20sec~ | 0.93 | 1.51 | 1.76 | 2.38 | 2.71 |
| 0.25sec~ | 0.10 | 0.23 | 0.06 | 2.14 | 2.10 |
| 0.30sec~ | 0.15 | 0.24 | 0.24 | 0.55 | 0.68 |
| 0.35sec~ | 0.00 | 0.24 | 0.24 | 0.55 | 0.68 |
| 0.40sec~ | 0.00 | 0.24 | 0.24 | 0.55 | 0.68 |
| 0.45sec~ | 0.00 | 0.24 | 0.24 | 0.55 | 0.68 |
| 0.50sec~ | 0.00 | 0.24 | 0.24 | 0.55 | 0.68 |
| 0.55sec~ | 0.00 | 0.24 | 0.24 | 0.55 | 0.68 |
| 0.60sec~ | 0.00 | 0.24 | 0.24 | 0.55 | 0.68 |
| 0.65sec~ | 0.00 | 0.24 | 0.24 | 0.55 | 0.68 |
| 0.70sec~ | 0.00 | 0.24 | 0.24 | 0.55 | 0.68 |
| 0.75sec~ | 0.00 | 0.24 | 0.24 | 0.55 | 0.68 |
| 0.80sec~ | 0.00 | 0.24 | 0.24 | 0.55 | 0.68 |
| 0.85sec~ | 0.00 | 0.00 | 0.00 | 0.00 | 0.00 |

FIG. 25

| | 0.0% ~ | 2.5% ~ | 5.0% ~ | 7.5% ~ | 10.0% ~ | 12.5% ~ | 15.5% ~ | 87.5% ~ | 90.0% ~ | 92.5% ~ | 95.0% ~ | 97.5% ~ |
|---|---|---|---|---|---|---|---|---|---|---|---|---|
| 1sec~ | 0.00 | 0.11 | 0.14 | 0.18 | 0.21 | 0.27 | 0.33 | 1.74 | 1.83 | 1.91 | 2.00 | 2.08 |
| 3sec~ | 0.00 | 0.14 | 0.13 | 0.12 | 0.12 | 0.16 | 0.20 | 0.66 | 0.67 | 0.67 | 0.68 | 0.68 |
| 5sec~ | 0.00 | 0.02 | 0.04 | 0.06 | 0.08 | 0.09 | 0.10 | 0.40 | 0.41 | 0.41 | 0.41 | 0.42 |
| 7sec~ | 0.00 | 0.03 | 0.07 | 0.10 | 0.13 | 0.14 | 0.15 | 0.51 | 0.54 | 0.56 | 0.58 | 0.60 |
| 9sec~ | 0.00 | 0.06 | 0.07 | 0.08 | 0.08 | 0.11 | 0.13 | 0.35 | 0.36 | 0.36 | 0.36 | 0.37 |
| 11sec~ | 0.00 | 0.04 | 0.04 | 0.05 | 0.06 | 0.07 | 0.08 | 0.30 | 0.31 | 0.32 | 0.32 | 0.33 |
| 21sec~ | 0.00 | 0.02 | 0.03 | 0.04 | 0.04 | 0.05 | 0.06 | 0.14 | 0.14 | 0.14 | 0.14 | 0.14 |
| 41sec~ | 0.00 | 0.02 | 0.02 | 0.03 | 0.04 | 0.04 | 0.04 | 0.13 | 0.13 | 0.13 | 0.14 | 0.14 |
| 61sec~ | 0.00 | 0.02 | 0.02 | 0.02 | 0.03 | 0.03 | 0.04 | 0.08 | 0.08 | 0.09 | 0.09 | 0.09 |
| 81sec~ | 0.00 | 0.01 | 0.01 | 0.02 | 0.02 | 0.02 | 0.03 | 0.06 | 0.05 | 0.05 | 0.05 | 0.05 |
| 101sec~ | 0.00 | 0.01 | 0.01 | 0.02 | 0.02 | 0.02 | 0.02 | 0.04 | 0.04 | 0.05 | 0.05 | 0.05 |
| 151sec~ | 0.00 | 0.01 | 0.01 | 0.01 | 0.01 | 0.01 | 0.01 | 0.02 | 0.02 | 0.02 | 0.02 | 0.02 |
| 301sec~ | 0.00 | 0.00 | 0.00 | 0.01 | 0.01 | 0.01 | 0.01 | 0.01 | 0.01 | 0.01 | 0.01 | 0.01 |
| 512sec~ | 0.00 | 0.00 | 0.00 | 0.00 | 0.00 | 0.00 | 0.00 | 0.00 | 0.00 | 0.00 | 0.00 | 0.00 |

FIG. 26

| TEMP DIFFERENCE | SET-UP | PRE-HEAT | INTERVAL | MAIN | WEIGHT |
|---|---|---|---|---|---|
| -52.5℃~ | 0.905μsec | 0.000μsec | 0.000μsec | 4.525μsec | 60% |
| -49.5℃~ | 0.905μsec | 0.000μsec | 0.000μsec | 4.525μsec | 60% |
| -46.5℃~ | 0.905μsec | 0.000μsec | 0.000μsec | 4.525μsec | 60% |
| -43.5℃~ | 0.905μsec | 0.000μsec | 0.000μsec | 4.525μsec | 60% |
| -40.5℃~ | 0.905μsec | 0.000μsec | 0.000μsec | 4.525μsec | 60% |
| -37.5℃~ | 0.905μsec | 0.000μsec | 0.000μsec | 4.525μsec | 60% |
| -34.5℃~ | 0.905μsec | 0.000μsec | 0.000μsec | 4.525μsec | 60% |
| -31.5℃~ | 0.905μsec | 0.000μsec | 0.000μsec | 4.525μsec | 60% |
| -28.5℃~ | 0.905μsec | 0.000μsec | 0.000μsec | 4.887μsec | 64% |
| -25.5℃~ | 0.905μsec | 0.000μsec | 0.000μsec | 5.068μsec | 68% |
| -22.5℃~ | 0.905μsec | 0.000μsec | 0.000μsec | 5.249μsec | 72% |
| -19.5℃~ | 0.905μsec | 0.000μsec | 0.000μsec | 5.611μsec | 76% |
| -16.5℃~ | 0.905μsec | 0.000μsec | 0.000μsec | 5.972μsec | 80% |
| -13.5℃~ | 0.905μsec | 0.000μsec | 0.000μsec | 5.973μsec | 84% |
| -10.5℃~ | 0.905μsec | 0.000μsec | 0.000μsec | 6.335μsec | 88% |
| -7.5℃~ | 0.905μsec | 0.000μsec | 0.000μsec | 6.516μsec | 92% |
| -4.5℃~ | 0.905μsec | 0.000μsec | 0.000μsec | 6.697μsec | 96% |
| -1.5℃~ | 0.905μsec | 0.000μsec | 0.000μsec | 7.059μsec | 100% |
| 1.5℃~ | 0.905μsec | 1.991μsec | 0.543μsec | 5.068μsec | 100% |
| 4.5℃~ | 0.905μsec | 1.991μsec | 0.905μsec | 5.068μsec | 100% |
| 7.5℃~ | 0.905μsec | 1.991μsec | 1.448μsec | 5.068μsec | 100% |
| 10.5℃~ | 0.905μsec | 1.991μsec | 1.991μsec | 5.068μsec | 100% |
| 13.5℃~ | 0.905μsec | 1.991μsec | 1.991μsec | 5.068μsec | 100% |
| 16.5℃~ | 0.905μsec | 1.991μsec | 1.991μsec | 5.068μsec | 100% |
| 19.5℃~ | 0.905μsec | 1.991μsec | 1.991μsec | 5.068μsec | 100% |
| 22.5℃~ | 0.905μsec | 1.991μsec | 1.991μsec | 5.068μsec | 100% |
| 25.5℃~ | 0.905μsec | 1.991μsec | 1.991μsec | 5.068μsec | 100% |
| 28.5℃~ | 0.905μsec | 1.991μsec | 1.991μsec | 5.068μsec | 100% |
| 31.5℃~ | 0.905μsec | 1.991μsec | 1.991μsec | 5.068μsec | 100% |
| 34.5℃~ | 0.905μsec | 1.991μsec | 1.991μsec | 5.068μsec | 100% |
| 37.5℃~ | 0.905μsec | 1.991μsec | 1.991μsec | 5.068μsec | 100% |

FIG. 29
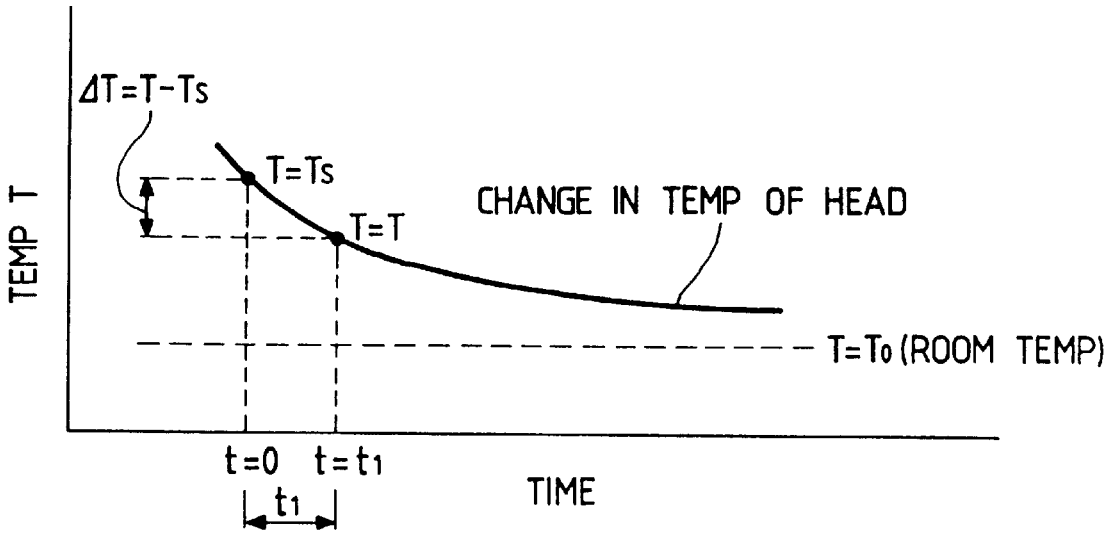
FIG. 30B
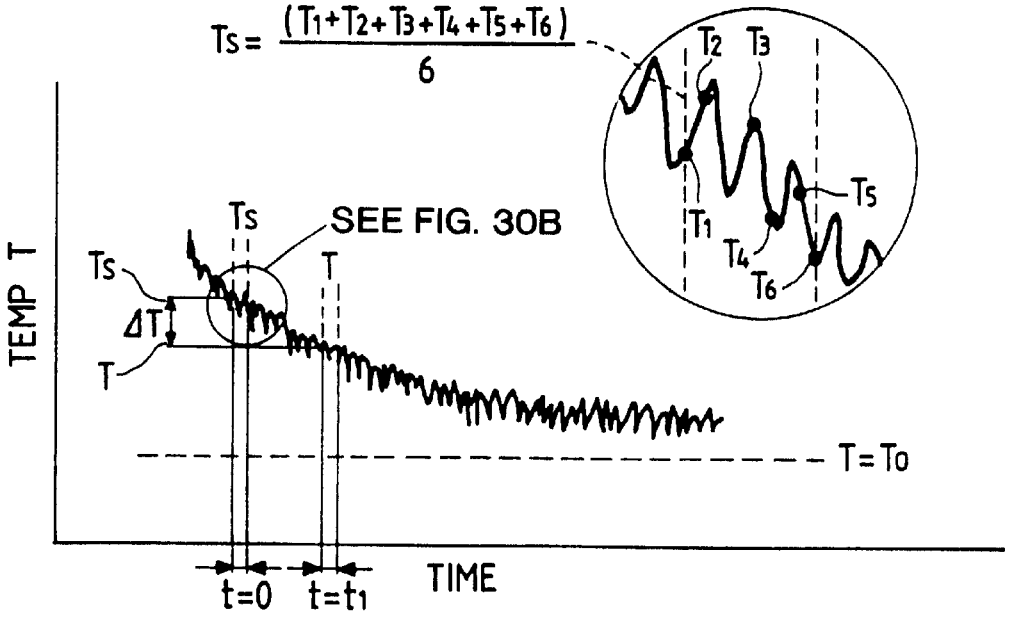
FIG. 30A $$T_S = \frac{T_{SK} + T_{SC} + T_{SM} + T_{SY}}{4}$$

$$T = \frac{T_K + T_C + T_M + T_Y}{4}$$

FIG. 32
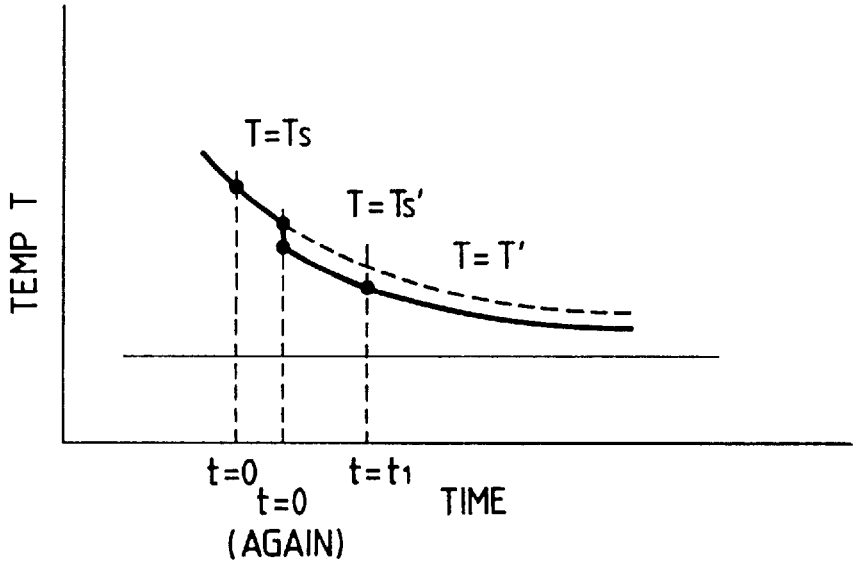
FIG. 33B
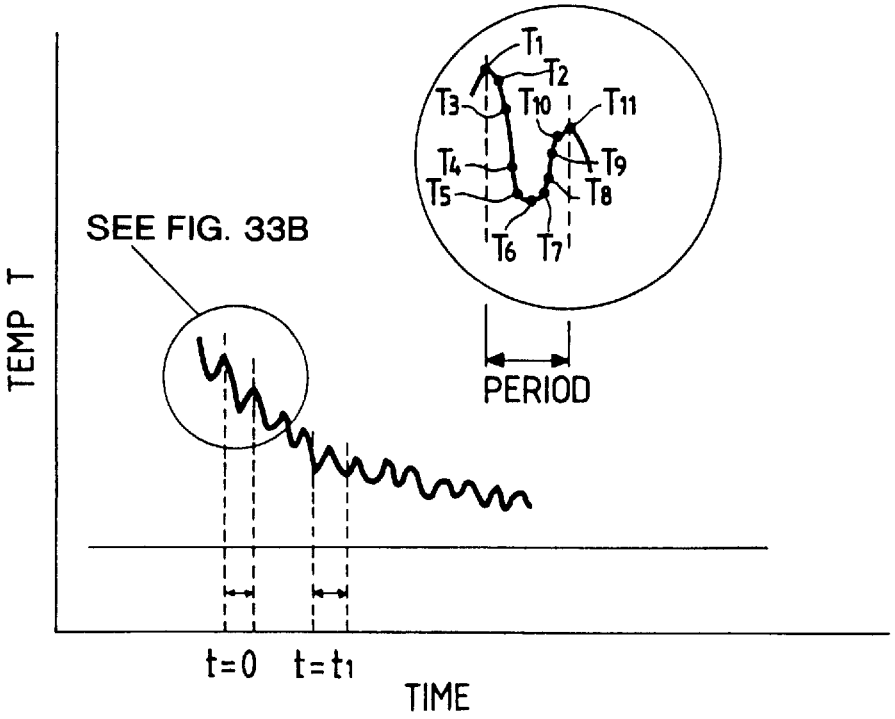
FIG. 33A

RECORDING METHOD AND APPARATUS FOR PRESUMING CHARACTERISTICS OF TEMPERATURE SENSORS

This application is a continuation of application Ser. No. 08/249,850 filed May 26, 1994, now abandoned.

BACKGROUND OF THE INVENTION

1. Field of the Invention

This invention relates to a recording method and apparatus which makes it possible to improve an image quality and throughput, and more particularly to an ink jet recording apparatus and its method wherein characteristics of temperature sensors can be obtained precisely in a short time.

2. Related Background Art

Recording apparatuses, such as a printer, a copying machine, and a facsimile, each have a configuration to form an image consisting of dot patterns on a recording medium such as a sheet of paper and a plastic sheet on the basis of image information.

The recording apparatuses can be classified into ink jet type, wire dot matrix type, thermal type, and laser beam type apparatuses according to their respective recording methods. The ink jet type apparatus (an ink jet recording apparatus) among them has a configuration in which ink droplets (recording droplets) are ejected and sprayed from ejection outlets of its recording heads so as to be deposited on the recording medium in recording.

Recently, a lot of types of recording apparatuses are used. They are, however, required to provide high-speed recording, high resolution, quality images, and lower noises. The above ink jet recording apparatus can satisfy these requirements. Among them there is an ink jet recording apparatus in which heat energy is given to ink in a nozzle to cause bubbles, so that the ink is ejected from the recording head by the expansion force for recording. Temperature management of the recording head is very important to stabilize the ink ejection and the ejection quantity necessary to satisfy the above requirements.

Therefore, in the conventional ink jet recording apparatuses, there has been used a procedure for controlling temperatures of recording heads so as to be within a required range on the basis of recording head temperatures detected by a so-called closed loop method in which a head temperature is detected by a temperature detecting means fit to a recording head portion or by a temperature calculation method in which a head temperature history is presumed by calculation from energy applied to the head, or by both methods.

As an example of a correction procedure for the above temperature detecting method, in Japanese Patent Application Laid-open No. 5-31906, values used for calculation (for example, tables) are corrected by using a difference between a temperature detected in a thermally stabilized status by the temperature detecting means on the recording head and the calculated temperature presumed by calculation. In Japanese Patent Application Laid-open No. 5-31918, a temperature detected by the temperature detecting means on the recording head is corrected with reference to a temperature detected by an ambient temperature detecting means incorporated in the main unit of the recording apparatus, when recording is not performed or at a timing when the temperature is not changed. Further, in Japanese Patent Application Laid-open No. 5-64890, a caluculated temperatue is corrected by using a ratio of the temperature detected by the temperature detecting means on the recording head to the above calculated temperature. These methods are used for correcting head characteristics such as a variation in the above temperature detecting means, differences between thermal time constants or those between thermal efficiencies at ink ejection in respective recording heads which are difficulties existent in replacement type recording heads.

In the above temperature calculation method, generally, temperature behavior (temperature raise) of an object is previously obtained, in respect to the downward movement of the object temperature at unit time intervals after the temperature raise caused by applied energy at unit time intervals, and then calculation is made to obtain the total sum of a difference between the current object temperature and the past temperature which has been raised at unit time intervals to presume the present object temperature.

A heater used for the temperature control is a heater member for heating joined to the recording head portion or a heater for ink ejection in an ink jet type recording apparatus which forms sprayed droplets by utilizing thermal energy for recording, in other words, means for ejecting ink droplets by utilizing expansion of bubbles due to boiling of an ink film. If the ink ejection heater is used, it is energized to an extent that bubbles are not expanded.

As mentioned above, the temperature management of the recording heads is important to allow the ink jet recording apparatus to effect stable ink ejection, therefore, it is intended to obtain temperatures of the recording heads precisely in various methods. However, if temperatures of recording heads are to be detected by temperature detecting means added to the recording heads, for example, if temperatures are to be detected by using temperature dependencies of output voltages of diode sensors, an offset (a variation of output values at the same temperature) has a substantial variation between respective sensors, though a proportional coefficient (hereinafter referred to "inclination") of a temperature-output voltage does not have any substantial variation between respective sensors (for the head temperature management). Accordingly, the head temperature as an absolute value cannot be obtained only from the same output voltage, unless characteristics (rank) of a Di sensor is acquired.

Therefore, the above rank is measured previously, for example, at manufacturing a recording head, and then the head is notched in association with rank values which have been measured or rank values that are previously stored in an EEPROM or other memories. It provides precise correction of the recording head temperatures if the rank values are read when the main unit is installed. If diode rank values are stored in the recording heads, however, it takes much time and labor to store them and a lot of cost since a storing means (for example, ROM) is needed for each recording head. In addition, in a method of detecting the diode ranks by utilizing combination of contacts for diode rank values made on the recording heads, there have been difficulties such as large-sized apparatuses and higher cost since it requires the contacts and wiring for reading by the amount of information.

Accordingly it can be considered as a method to solve the problems that the recording apparatus main unit is used to measure the diode ranks of the recording heads. More specifically, it is a method in which correction is made so that a thermistor temperature matches the diode sensor temperature when the temperature value of the thermistor in the main unit is considered to be the same as the recording head temperature.

However, when a new recording head is mounted on the main unit, conventionally the new recording head may have been left in an environment different from that of the main unit, in other words, in an environment whose temperature is extremely different from that of an environment in which the main unit is installed, such as in a warehouse cold in winter or in a car hot in summer, which is an extreme case.

If so, as described in the above, it needs a substantial waiting time after the recording head is mounted on the main unit to measure the diode rank. In addition, if the diode rank is measured without the waiting time, the measurement error of the rank value may be too big to obtain the recording head temperature precisely. The method has a difficulty that it sometimes leads to a failure of stabilization in the ink ejection from the recording head or in the amount of the ink ejection.

SUMMARY OF THE INVENTION

It is an object of the invention to provide an ink jet recording apparatus and its method in which characteristics of temperature sensors of a new recording head can be obtained precisely and in a short time.

It is another object of the present invention to provide an ink jet recording apparatus and its method in which recording head temperatures are read exactly so as to stabilize its ink ejection.

To accomplish the above objects, the present invention provides a recording apparatus having a temperature sensor and a recording head mounted thereon for recording with thermal energy, including a detecting means for detecting that said mounted recording head has been replaced, a presuming means for presuming characteristics of a temperature sensor of said replaced recording head when replacement of said recording head is sensed by said detecting means, and a correcting means for correcting a sensed temperature of said temperature sensor by using characteristics presumed by said presuming means.

In addition, this invention provides a recording method of recording with a recording head having a thermal sensor to record images by using thermal energy, including the steps of detecting that said mounted recording head has been replaced, presuming characteristics of a temperature sensor on said recording head which has been replaced when the replacement is sensed, and correcting sensed temperatures of said temperature sensor by using the presumed characteristics.

BRIEF DESCRIPTION OF THE DRAWINGS

FIG. 3 is a diagram illustrating a correspondence between a head rank and an ejection heater resistor value.

FIG. 18 is a target temperature to an ambient temperature conversion table.

FIG. 21 is a table showing a time division for calculating temperatures.

FIG. 22 is an ejection heater short range calculation table.

FIG. 23 is an ejection heater long range calculation table.

FIG. 24 is a sub-heater short range calculation table.

FIG. 25 is a sub-heater long range calculation table.

FIG. 26 is a PWM value table listing pulse widths each for differences between a target temperature and a head temperature.

FIG. 29 is a graph describing the first embodiment.

FIG. 30A is a graph describing the second embodiment, and FIG. 30B is an enlargement of the circled portion of FIG. 30A.

FIG. 32 is a graph describing the fourth embodiment.

FIG. 33A is a graph describing the fifth embodiment, and FIG. 33B is an enlargement of the circled portion of FIG. 33A.

DETAILED DESCRIPTION OF THE PREFERRED EMBODIMENTS

1st Embodiment

Figure 7:
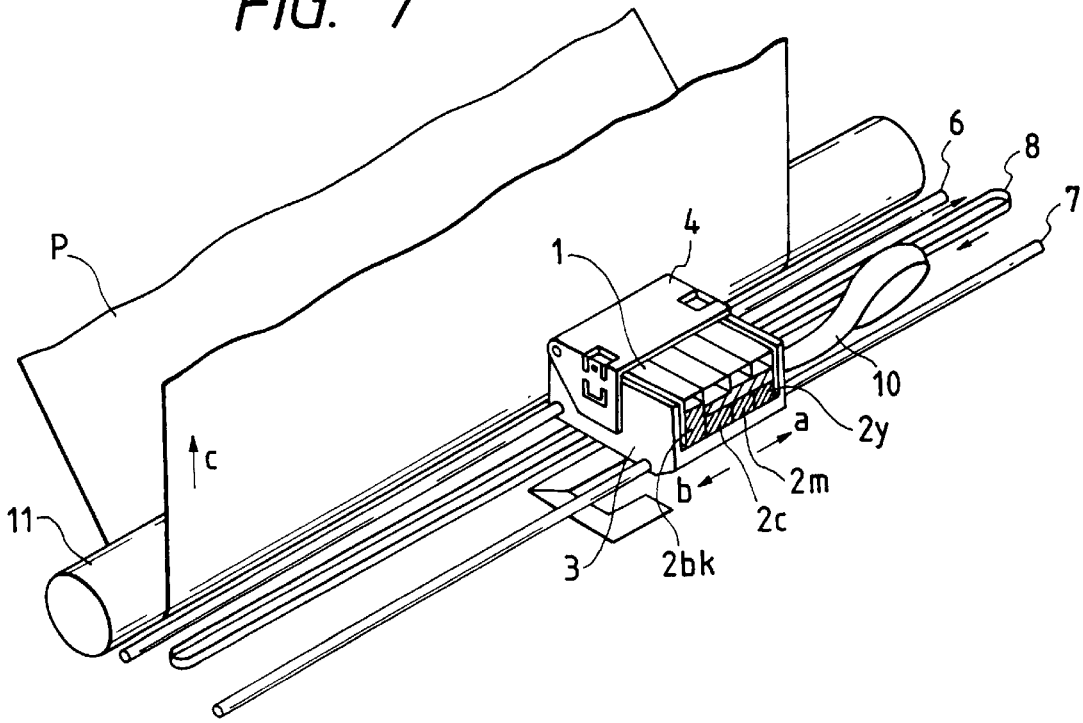
FIG. 7 is a perspective view illustrating an entire recording apparatus.

FIG. 7 illustrates a serial type ink jet color printer using the present example. Recording heads 1 are each a device which is provided with a plurality of nozzle rows and adapted to record an image by ejecting ink droplets through the nozzle rows and causing the ink droplets to land on a recording medium 8 and form ink dots thereon. (In the diagram, the components mentioned are covered by a recording head fixing lever and are not directly indicated.) In the present example, a plurality of printing heads jointly form each of the recording heads 1 so as to permit ejection of ink droplets of a plurality of colors as will be described more specifically hereinbelow. Inks of different colors are ejected from different printing heads and a color image is formed on the recording medium P owing to the mixture of such different colors of the ink droplets.

Print data are transmitted from an electric circuit of the printer proper to the printing heads through the medium of a flexible cable 10. Printing head rows 1K (black), 1C (cyan), 1M (magenta), and 1Y (yellow), in the construction of this diagram, are formed by the collection of recording heads severally assigned to the four colors. The recording heads 1 are freely attachable or detachable to a carriage 3. In the forward scan, the inks of different colors mentioned above are ejected in the order mentioned. In the formation of red (hereinafter referred to as R), for example, magenta (hereinafter referred to as M) is ejected to land on the recording medium P first and then yellow (hereinafter referred to as Y) is ejected to land on the previously formed dots of M, with the result that red dots will consequently appear. Likewise, green (hereinafter referred to as G) is formed by causing C and Y to land on the recording medium P and blue (hereinafter referred to as B) is formed by causing C and M to land thereon respectively in the order mentioned. The printing heads are arrayed at a fixed interval (P1). The formation of a solid G print, therefore, requires Y to land on the recording medium with a time lag of 2*P1 following the landing of C thereon. Thus, a solid Y print is superposed on a solid C print.

The carriage 3 has the motion thereof in the direction of main scan controlled by unshown position sensing means detecting continuously the scanning speed and the printing position of the carriage. The power source for the carriage 3 is a carriage drive motor. The carriage 3, with the power transmitted thereto through the medium of a timing belt 8, is moved on guide shafts 6 and 7. The impression of prints proceeds during the motion of the carriage 3 for main scan. The printing action in the vertical direction selectively effects unidirectional printing and bidirectional printing. Generally the unidirectional printing produces a print only during the motion of the carriage away (the forward direction) from the home position thereof (hereinafter referred to as HP) and not during the motion thereof toward the HP (the backward direction). Thus, it produces a print of high accuracy. In contrast thereto, the bidirectional printing produces a printing action in both the forward and the backward direction. It, therefore, permits high-speed printing.

In the sub-scan direction, the recording medium P is advanced by a platen roller 11 which is driven by a paper feed motor not shown in the diagram. After the paper fed in the direction indicated by the arrow C in the diagram has reached the printing position, the printing head rows start a printing action.

Figure 8:
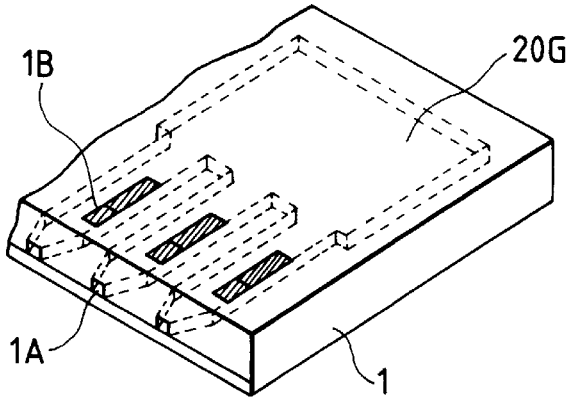
FIG. 8 is a perspective view illustrating a structure of a printing head.
Figure 9:
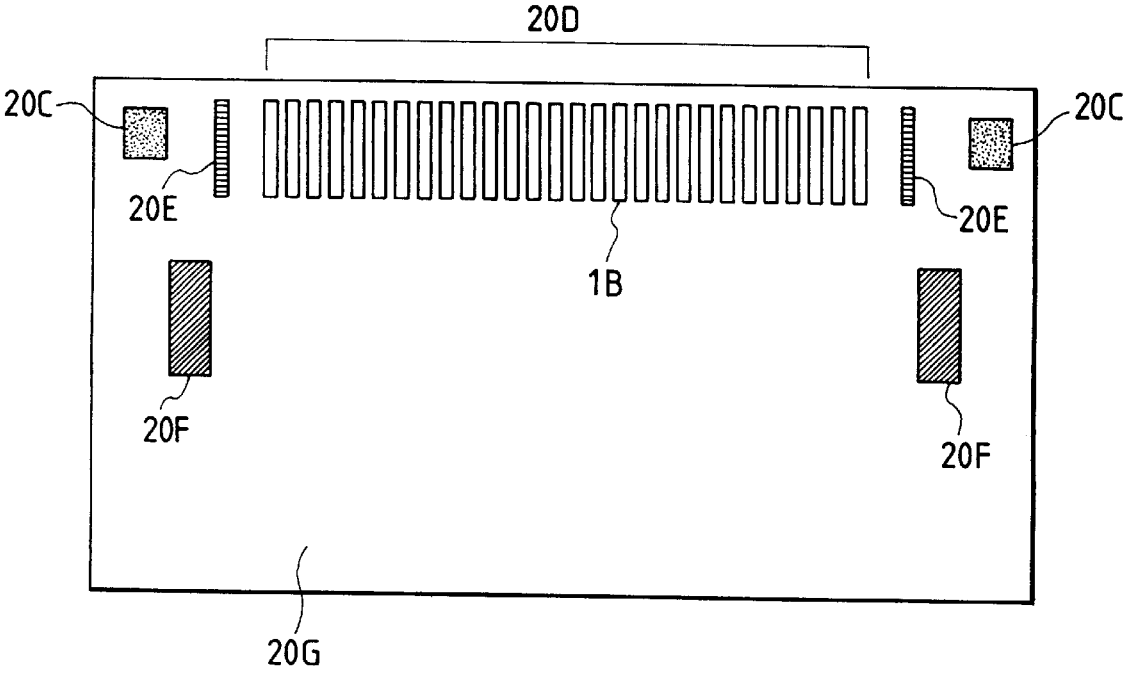
FIG. 9 is an inside view of a heater board of the printing head.

Now, the recording heads 1 will be detailed below. As illustrated in FIGS. 8 and 9, a plurality of ejection nozzles 1A for ejecting ink droplets are disposed in a row on a heater board 20G of the printing heads and electric thermal transducers (hereinafter referred to as "ejection heaters 1B") for generating thermal energy by use of voltage applied thereto are disposed one each in the ejection nozzles 1A so as to cause ejection of ink droplets through the ejection nozzles 1A. The printing heads, in response to a drive signal exerted thereon, cause the ejection heaters 1B to generate heat and induce the ejection of ink droplets. On the heater board 20G, an ejection heater row 20D having a plurality of ejection heaters 1B arrayed thereon is disposed. Dummy resistors 20E incapable of ejecting ink droplets are disposed one each near the opposite ends of the ejection heater row 20D. Since the dummy resistors 20E are fabricated under the same conditions as the ejection heater 1B, the energy (Watt/hr) formed severally by the ejection heaters 1B in response to the application thereto of a fixed voltage can be detected by measuring the magnitude of resistance produced in the dummy resistors 20E. Since the formed energy of the ejection heaters 1B can be computed as $V^2/R$, wherein V stands for the applied voltage (Volt) and R for the resistance (Ω) of the ejection heaters, the characteristics of the ejection heaters 1B are dispersed similarly to those of the resistors 20E. These resistors 1B and 20E possibly have their characteristics dispersed within a range of ±15%, for example, by reflecting the inconstancy of craftsmanship encountered by them in the process of manufacture. The recording heads are enabled to enjoy an elongated service life and produce images of exalted quality by detecting the dispersion of the characteristics of the ejection heaters 1B and optimizing the drive conditions of the recording heads based on the outcomes of the detection.

Since the ink jet printer of the present type accomplishes the ejection of ink droplets by exerting thermal energy on the ink, the recording heads require temperature control. For the sake of this temperature control, therefore, diode sensors 20C are disposed on the heater board 20G and operated to measure the temperature of the neighborhood of the ejection heaters 1B. The results of this measurement are utilized for controlling the magnitude of the energy which is required for the ink ejection or the temperature control. In the present example, the average of the degrees of temperature detected by the diode sensors 20C forms the detected temperature.

The inks by nature gain in viscosity at low temperatures possibly to the extent of obstructing the ejection. For the purpose of precluding this adverse phenomenon, electric thermal transducers (hereinafter referred to as "sub-heaters 20F") are provided separately of the ink ejection nozzles on the heater board 20G. The energy supplied to the sub-heaters 20F is likewise controlled by the diode sensors 20C. Since the sub-heaters 20F are manufactured under the same conditions as the ejection heaters 1B, the dispersion of the magnitudes of resistance manifested by the sub-heaters 20F can be detected by measuring the magnitudes of resistance of the dummy resistors 20E mentioned above.

Since the components mentioned above are invariably disposed on one and the same substrate as described above, the temperatures of the heads can be detected and controlled with high efficiency and the heads can be miniaturized and manufactured by a simplified process.

Figure 10:
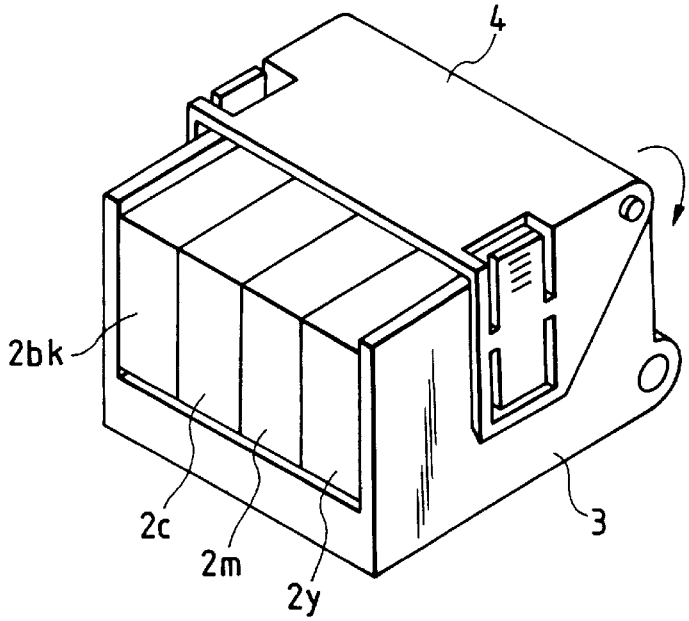
FIG. 10 is a perspective view illustrating a carriage.
Figure 11:
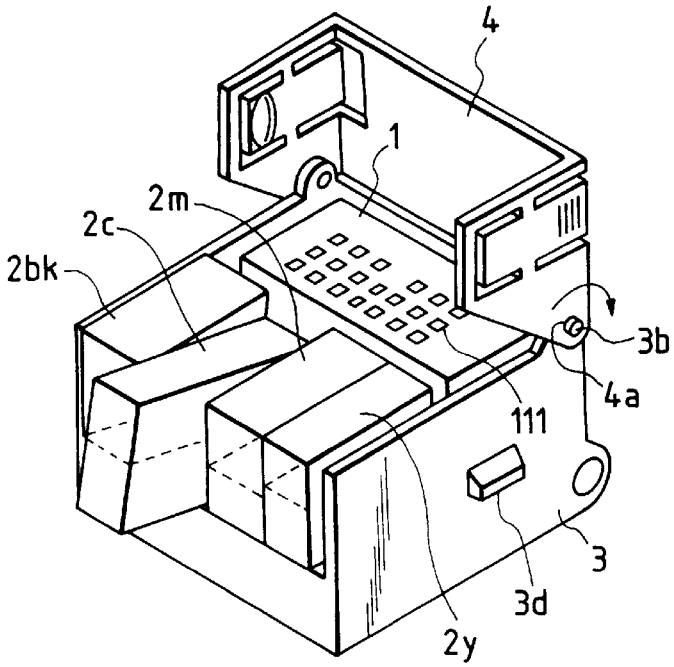
FIG. 11 is a diagram illustrating a recording head mounted on the carriage.

Now, the recording heads mounted on the carriage will be described below. As illustrated in FIG. 10 and FIG. 11, the four printing heads (FIG. 8) serving the purpose of ejecting inks of the four colors R, C, M, and Y and ink tanks 2*bk*, 2*c*, 2*m*, and 2*y* for storing and supplying the respective inks are mounted in the carriage 3. These four ink tanks are so constructed as to be attached to and detached from the carriage 3. When they are emptied of their ink supplies, they can be replaced with newly supplied ink tanks.

A recording head fixing lever 4 is intended to position and fix the recording heads 1 on the carriage 3. Bosses 3*b* of the carriage 3 are rotatably inserted into holes 4*a* of the recording head fixing lever 4. The lever 4 which is normally kept in a closed state is opened to allow the operator access to the recording heads 1 and permit their replacement. Further, the engagement of the recording head fixing lever 4 with stoppers 3*d* of the carriage 3 ensures infallible fixation of the recording heads 1 on the carriage 3. Besides, a group of contacts 111 on the recording heads 1 join a group of matched contacts on the unshown recording head fixing lever. Owing to the union of these groups of contacts, the drive signals for driving the ejection heaters and sub-heaters of the printing heads assigned to the four colors and the data of head characteristics and the numerical values as the results of detection of the diode sensors can be transmitted from the recording apparatus proper or rendered detectable.

Now, the algorithm for the computation of head temperatures will be described.

(Outline of overall flow of control)

In the ink jet recording apparatus, the operation of ejection and the amount of ejection can be stabilized and the impartation of high quality to images to be recorded can be attained by controlling the temperatures of the recording heads within a fixed range. The means for computation and detection of the temperatures of the recording heads and the method for controlling the optimum drives for such temperatures which are adopted in the present example for the purpose of realizing stable recording of images of high quality will be outlined below.

(1) Setting of target temperature

The control of head drive aimed at stabilizing the amount of ejection which will be described below uses the tip temperature of a head as the criterion of control. To be more specific, the tip temperature of a head is handled as a substitute characteristic to be used for the detection of the amount of ejection per dot of the relevant ink being ejected at the time of detection. Even when the tip temperature is fixed, the amount of ejection differs because the temperature of the ink in the tank depends on the environmental temperature. The tip temperature of the head which is set to equalize the amount of ejection at a varying temperature (namely at a varying ink temperature) for the purpose of eliminating the difference mentioned above constitutes itself a target temperature. The target temperatures are set in advance in the form of a table of target temperatures. The table of target temperatures to be used in the present example are shown in FIG. 18.

(2) Means for computation of recording head temperature

The algorithm of temperature computation to determine the change of temperature of the recording head is handled as an accumulation of discrete variables per unit time. The change of temperature of the recording head which corresponds to the discrete variables mentioned above is computed and tabulated in advance. The temperature computation is carried out by use of a two-dimensional table which is formed with a two-dimensional matrix representing the magnitude of energy consumed per unit time and the elapsed time. Recording heads formed as a model by assembling a plurality of members differing in thermal conduction time are used as substitutes at a smaller number of heat time constants than actual. The interval of computations required and the duration of retention of data required are separately computed for each model unit (heat time constant). Further, the head temperature is computed by setting a plurality of heat sources, computing the width of temperature rise by the model unit mentioned above for each of the heat sources, and then totaling the widths obtained by the computation (algorithm for computation of a plurality of heat sources). The algorithm allows the change of temperature of the recording head even in an inexpensive recording apparatus to be completely computed and coped with without requiring the otherwise inevitable provision of a temperature sensor on the recording head.

(3) PWM control

The stabilization of the amount of ejection can be attained when the head under a varying environment is driven at the tip temperature indicated in the table of target temperatures mentioned above. Actually, however, the tip temperature is not constant because it sometimes varies with the printing duty. The means to drive the head by use of the multipulse PWM and control the amount of ejection without relying on temperature for the purpose of stabilizing the amount of ejection constitutes itself the PWM control. In the present example, a PWM table defining the pulses of optimum waveforms/widths at existent times based on the differences between the head temperature and the target temperatures under existent environments are set in advance. The drive conditions for ejection are fixed based on the data of this table.

(4) Control of sub-heater drive

The control which is attained by driving a sub-heater and approximating the head temperature to the target temperature when the PWM drive fails to obtain a desired amount of ejection forms the control of a sub-heater. The sub-heater control enables the head temperature to be controlled in a prescribed temperature range.

(Estimation and control of temperature)

The basic formula for the estimation of the temperature of a recording head in the apparatus under discussion conforms with due modifications to the following general formula for thermal formula.

During uninterrupted heating $$\Delta\text{temp}=a\{1-\exp[-m*T]\} \quad (1)$$

During heating switched midway to cooling $$\Delta\text{temp}=a\{\exp[-m(T-T1)]-\exp[-m*T]\} \quad (2)$$

wherein temp stands for temperature rise of object, a for temperature of object equilibrated by use of heat source, T for elapsed time, m for heat time constant of object, and T1 for duration of suspended use of heat source.

Theoretically, the tip temperature of the recording head can be estimated by computing the formulas (1) and (2) given above in accordance with the printing duty for a relevant heat time constant, providing that the recording head is handled as a series of lumped constants.

Generally, however, the problem of speed of processing prevents the computations mentioned above to be carried out without modification.

Strictly, the number of necessary arithmetic operations is colossal because all the component members have different time constants and time constants arise among the members.

Generally, the time for the computations cannot be shortened because the exponential operations cannot be performed directly with MPU and must rely on approximation or consultation of a conversion table.

The problems cited above are solved by the modeling and the operational algorithm shown below.

Modeling

Figure 19:
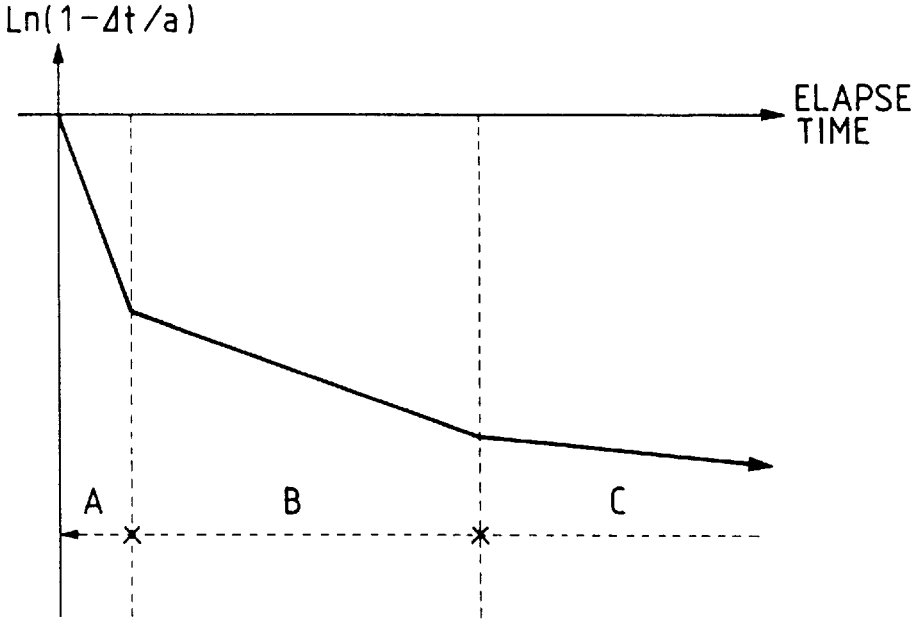
FIG. 19 is a diagram illustrating a temperature rising process of the recording head in a recording head temperature presuming calculation.

An experiment carried out by feeding energy to the recording head constructed as described above and sampling pertinent data during the rise of temperature of the recording head yielded the results shown in FIG. 19.

Though the recording head constructed as described above results from assembling numerous members differing in time of thermal conduction, this recording head can be practically treated as a single member with respect to thermal conduction so long as the differential value of the functions of elapsed time and data of temperature rise elapsed time obtained by the aforementioned logarithmic conversion is constant (namely, within the ranges A, B, and C on FIG. 19 wherein the inclinations are fixed).

In the light of the test results mentioned above, the present example has elected to handle the recording head with two heat time constants in the model associated with thermal conduction. (Though the results indicate that the regression can be performed more accurately by use of a model having three heat time constants, the present example has elected to model the recording head with two heat time constants by concluding that the inclinations in the areas of B and C of the table are substantially equal and giving a preference to the efficiency of arithmetic operations to be involved.) To be specific, one of the two magnitudes of thermal conduction pertains to a model having a time constant such that the temperature is equilibrated in 0.8 second (equivalent to the area of A in FIG. 19) and the other magnitude of thermal conduction pertains to a model having a time constant such that the temperature is equilibrated in 512 seconds (equivalent to the areas of B and C in FIG. 19).

The series of lumped constants is impariably resorted to on the assumption that the temperature distribution during the thermal conduction deserves to be disregarded.

Figure 20:
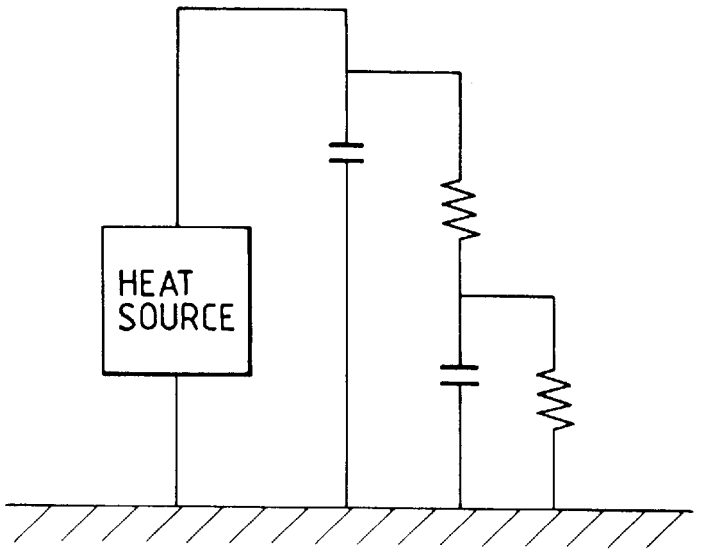
FIG. 20 is a diagram of a thermal conduction equivalent circuit modeled in the recording head temperature presuming calculation.

Two heat sources, i.e. the heat to be used for printing and the heat of the sub-heater, are assumed. FIG. 20 shows an equivalent circuit of model thermal conduction. The diagram depicts the case of using only one heat source. When the use of two heat sources is contemplated, they may be disposed in a series construction.

Algorithm of arithmetic operations

The present example computes the head temperature by expanding the aforementioned general formulas on thermal conduction as follows.

<Change of temperature after elapse of nt hours following the start of the power source>

$$
\begin{aligned}
a\{1-\exp[-m*n*t]\} &= a\{\exp[-m*t]-\exp[-m*t]+ && \langle 1\rangle\\
&\quad \exp[-2*m*t]-\exp[-2*m*t]+\\
&\quad \ldots+\exp[-(n-1)*m*t]-\\
&\quad \exp[-(n-1)*m*t]+1-\\
&\quad \exp[-n*m*t]\}\\
&= a\{1-\exp[-m*t]\}+a\{\exp[-m*t]-\\
&\quad \exp[-2*m*t]\}+a\{\exp[-2*m*t]-\\
&\quad \exp[-3*m*t]\}\\
&\quad \ldots\\
&\quad +a\{\exp[-(n-1)*m*t]-\\
&\quad \exp[-n*m*t]\}\\
&= a\{1-\exp[-mt]\}+ && \langle 2\text{-}1\rangle\\
&\quad a\{\exp[-m*(2t-t)]- && \langle 2\text{-}2\rangle\\
&\quad \exp[-m*2t]\}+\\
&\quad a\{\exp[-m*(3t-t)]- && \langle 2\text{-}3\rangle\\
&\quad \exp[-m*3t]\}+\\
&\quad \ldots\\
&\quad +a\{\exp[-m*(nt-t)]- && \langle 2\text{-}n\rangle\\
&\quad \exp[-m*nt]\}
\end{aligned}
$$

The expansion shown above indicates that the formula <1> coincides with <2-1>+<2-2>+<2-3>+ . . . +<2-n>. Here, the formula <2-n> represents the temperature of a given object at the point of time of nt which is found when the object is heated from the point of time of 0 to that of t and the heating is suspended between the point of time of t and that of nt.

The formula <2-3> represents the temperature of the object at the point of time of nt which is found when the object is heated from the point of time of (n−3)t to that of (n−2)t and the heating is suspended between the point of time of (n−2)t and that of nt.

The formula <2-2> represents the temperature of the object at the point of time of nt which is found when the object is heated from the point of time of (n−2)t to that of (n−1)t and the heating is suspended between the point of time of (n−1)t and that of nt.

The formula <2-1> represents the temperature of the object at the point of time of nt which is found when the object is heated between the point of time of (n−1)t and that of nt.

The fact that the sum of the formulas mentioned above equals the formula <1> aptly indicates that the behavior of temperature (rise of temperature) of a given object 1 can be arithmetically estimated by measuring the graduations of drop of the temperature of the object 1 per unit time from the temperature of the object 1 to which the object 1 has been heated by use of energy imparted thereto per unit time (the statement equivalent to each of the formulas <2-1>, <2-2>, - - - <2-n>) and then adopting as an estimate of the existent temperature of the object 1 the sum of the graduations at which the temperature of the object 1 formerly raised per unit time ought to have dropped to the existent temperature (the statement equivalent to the sum of the formula <2-1>+ <2-2>+ - - - <2-n>).

In the light of the foregoing, the present example elects to perform four times (the product; 2 power sources*2 heat time constants) the computation of the tip temperature of the recording head on the basis of the modeling mentioned above.

The intervals necessary for the computation and the durations of retention of data which are to be used for each of the four rounds of computation are shown in FIG. 21.

Tables of arithmetic operations which are two-dimensional matrixes having the magnitudes of energy imparted and the lengths of time elapsed arrayed for the computation of the head temperature mentioned above are shown in FIG. 22 to FIG. 25.

FIG. 22 represents a table for the computation of heat sources; ejection heaters, time constants; and short-range groups of members, FIG. 23 a table for the computation of heat sources; ejection heaters, time constants; and long-range groups of members, FIG. 24 a table for the computation of heat sources; sub-heaters, time constants; and short-range groups of members, and FIG. 25 a table for the computation of heat sources; sub-heaters, time constants; and long-range members of members.

The head temperature at a given time can be computed as hereinbelow. At intervals of 0.05 second, there are conducted the operations of (1) measuring the rise (ΔTmh) of temperature caused in the members of heat time constants represented by the short ranges in consequence of the drive of the heaters for the ejection and (2) measuring the rise (ΔTsh) of temperature caused in the members of heat time constants represented by the short ranges in consequence of the drive of the sub-heaters. Also, at intervals of 1 second, there are conducted the operations of (3) measuring the rise (ΔTmh) of temperature caused in the members of heat time constants represented by the long ranges in consequence of the drive of the heaters for the ejection and (4) measuring the rise (ΔTsh) of temperature caused in the members of heat time constants represented by the long ranges in consequence of the drive of the sub-heaters. Then results, ΔTmh, ΔTsh, ΔTmb, and ΔTsb, are totalled (=ΔTmh+ΔTsh+ΔTmb+ΔTsb).

As the result of adopting the modeling means of substituting the recording head formed by assembling a plurality of members differing in thermal conduction time with a smaller number of heat time constants than actual as a model, (i) the amount of processing of arithmetic operations can be appreciably decreased without noticeably sacrificing the accuracy of operation as compared with the amount of processing of arithmetic operations performed faithfully with respect to all the heat time constants of the members differing in thermal conduction time and those among the individual members and (ii) the processing of arithmetic operations can be performed with a small number of rounds without a sacrifice of the accuracy of computation on account of the use of time constants as a criterion of determination (in the case of the foregoing example, if the modeling is not effected for each of the time constants, then the intervals of 50 msec to be fixed in the area of A having a small time constant will have to be used for the necessary processing of arithmetic operations and the durations of 512 sec to be fixed in the areas of B and C having a large time constant will have to be used for the retention of the data of discrete variables, with the result that 10240 pieces of data produced theretofore at intervals of 50 msec over a period of 512 seconds ought to be subjected to a processing of cumulative operations and the number of rounds of processing consequently increased to some hundreds of times of the number required in the present example).

Thus, the change of the temperature of the recording head can be wholly processed by the arithmetic operations as described above.

Further, the PWM drive control intended to control the temperature of the recording head in a stated range as will be described specifically hereinbelow and the control of sub-heaters can be suitably carried out and the stabilization of the operation of ejection and the amount of ejection can be attained and the impartation of high quality to the produced images can be accomplished.

(PWM Control)

Now, the method for controlling the amount of ejection according to the present example will be detailed below with reference to the drawings.

Figure 14:
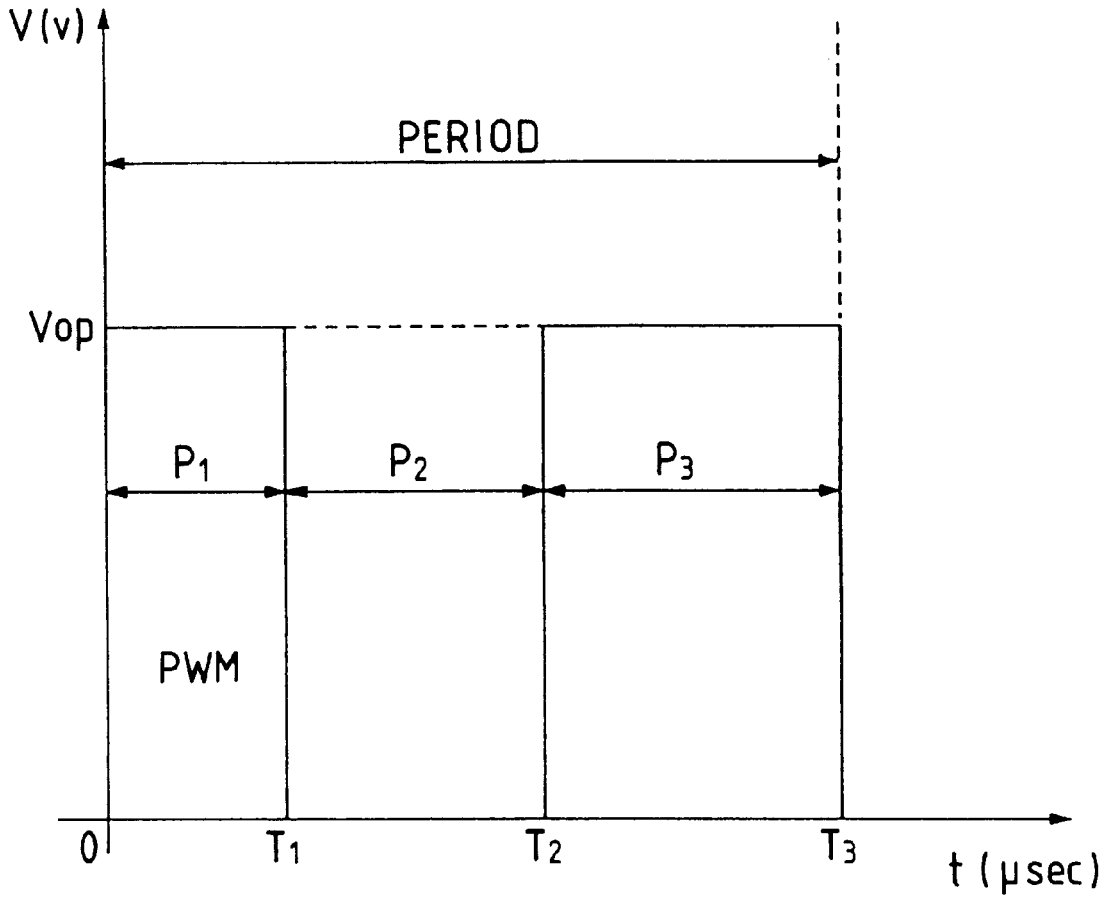
FIG. 14 is a description diagram of a divided pulse width modulation driving method.

FIG. 14 is a diagram for aiding in the description of split pulses as one embodiment of the present invention. In the diagram, $V_{op}$ stands for a drive voltage, $P_1$ for the width of the first of a plurality of split heat pulses (hereinafter referred to as a "preheat pulse"), $P_2$ for an interval time, and $P_3$ for the width of the second pulse (hereinafter referred to as a "main heat pulse"), and $T_1$, $T_2$, and $T_3$ stand respectively for lengths of time for fixing $P_1$, $P_2$, and $P_3$. The drive voltage $V_{op}$ is one of the magnitudes of electric energy necessary for enabling the electric thermal transducer receiving the voltage to induce generation of thermal energy in the inks which are held inside the ink conduits and defined by the heater board and the ceiling board. The magnitude of this drive voltage is determined by the surface area, magnitude of resistance, and film construction of the electric transducer and the liquid conduits of the recording head. The method of driving for modulation of split pulse width consists in successively providing pulses in the widths of $P_1$, $P_2$, and $P_3$. The preheat pulse is intended mainly to control the temperatures of the inks held in the liquid conduits and adapted to discharge an important roll of controlling the amount of ejection in this invention. The width of the preheat pulse is so set that the thermal energy generated by the electric transducer receiving the preheat pulse may avoid inducing the phenomenon of effervescence in the inks.

The interval time is used for the purpose of interposing a fixed time interval between the preheat pulse and the main pulse thereby preventing the two pulses from interfering with each other and for uniformizing the temperature distribution in the inks held in the ink conduits. The main heat pulse serves the purpose of causing effervescence in the inks in the ink conduits and inducing ejection of the inks through the nozzles. The width $P_3$ of the main heat pulse is determined by the surface area, magnitude of resistance, and film construction of the electric transducer and the liquid conduits of the recording head.

Figure 15A:
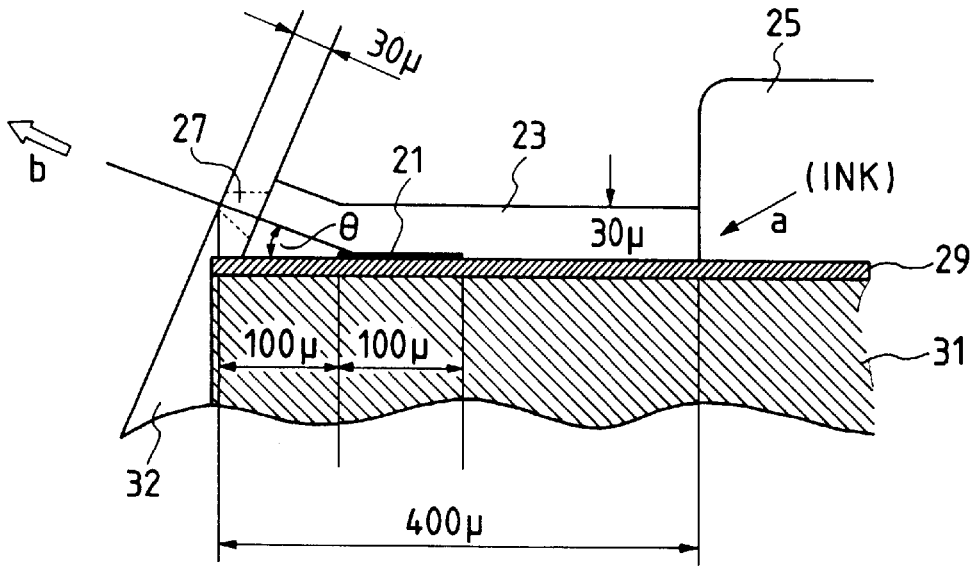
FIGS. 15A and 15B are diagrams illustrating a structure of the printing head.
Figure 15B:
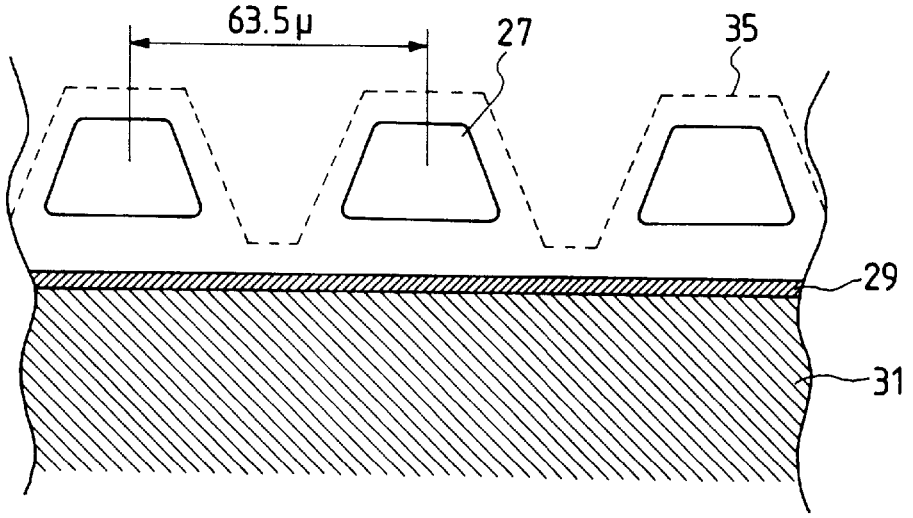

Now, the function of the preheat pulse in the recording head constructed as illustrated in FIGS. 15A and 15B will be described below. FIGS. 15A and 15B respectively represent a schematic longitudinal cross section taken along an ink conduit and a schematic front view, jointly illustrating one example of the construction of a recording head capable of utilizing the present invention. In the diagrams, an electric thermal transducer (ejection heater) 21 generates heat on receiving the split pulses mentioned above. This electric thermal transducer 21 is disposed on the heater board in conjunction with electrodes and wiring required for the application of the split pulses thereto. The heater board is formed of silicon 29 and supported by an aluminum plate 31 which serves as the substrate for the recording head. A ceiling board 32 has incised therein grooves 35 which are intended to form ink conduits 23. The union of the ceiling board 32 with the heater board (aluminum plate 31) gives rise to the ink conduits 23 and a manifold chamber 25 serving the purpose of supplying inks to the ink conduits 23. The ceiling board 32 has discharge mouths (or ejection orifices) 27 with which the relevant ink conduits 23 communicate.

Figure 16:
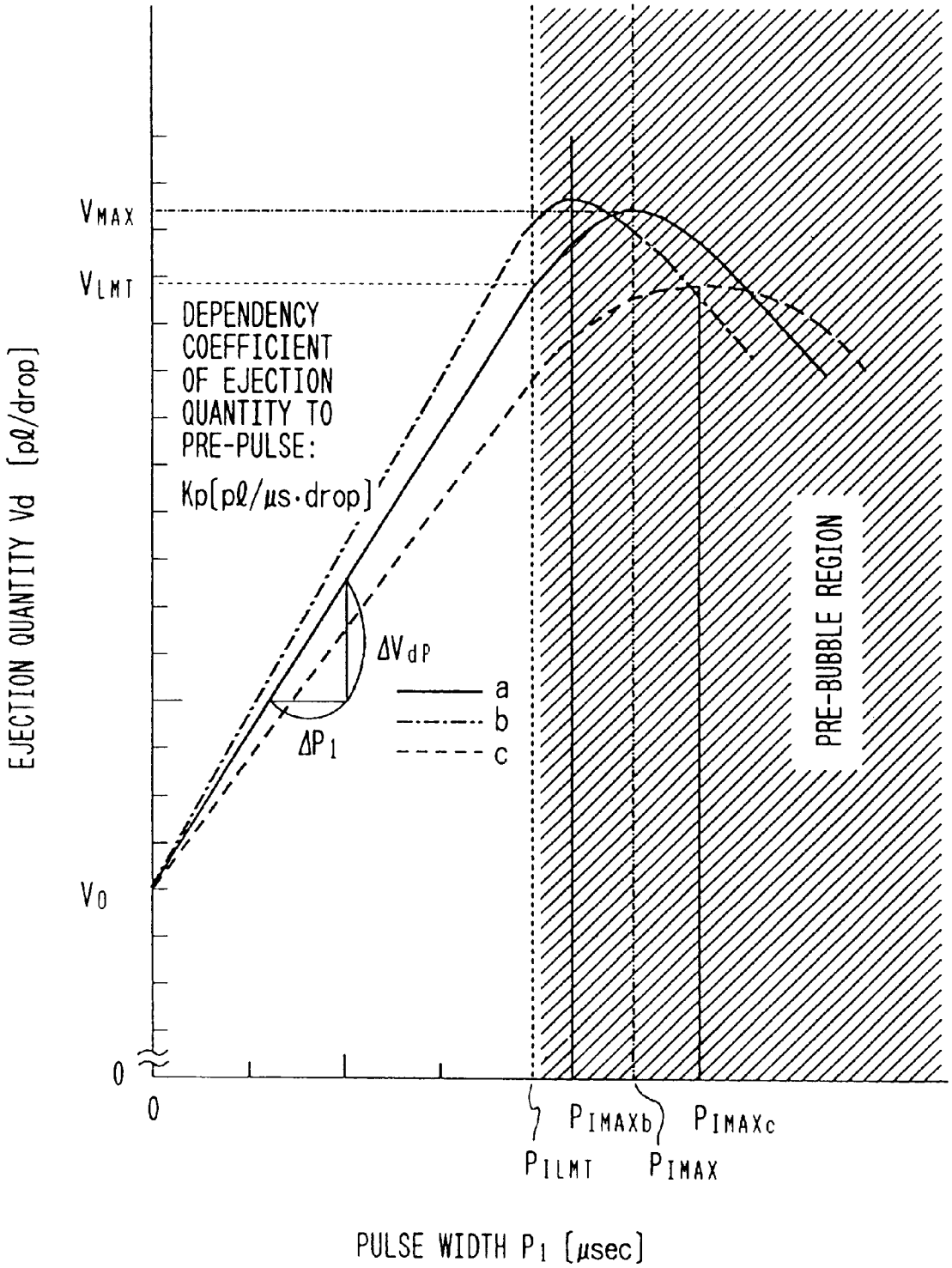
FIG. 16 is a diagram illustrating dependency of ejection quantity to pre-heat pulses.

FIG. 16 is a diagram illustrating the dependency of the amount of ejection on the preheat pulse. In the diagram, $V_0$ stands for the amount of ejection obtained for $P_1$=0 [μsec] and the magnitude of this amount is determined by the construction of the head illustrated in FIGS. 15A and 15B. It is remarked from the curve a of FIG. 16 that the amount of ejection $V_d$ increases with linearity proportionately to the increase of the width $P_1$ of the preheat pulse between 0 and $P_1$LMT and the change of the amount of ejection loses the linearity when the pulse width $P_1$ surpasses $P_1$LMT and reaches saturation at the pulse width of $P_1$MAX.

The range up to the pulse width $P_1$LMT in which the change of the amount of ejection $V_d$ due to the change of the pulse width $P_1$ manifests the linearity is effectively utilized as the range in which the control of the amount ejection is easily attained by changing the pulse width $P_1$.

When the pulse width is larger than $P_1$MAX, the amount of ejection $V_d$ becomes smaller than $V_{MAX}$. When a preheat pulse having a pulse width falling in the aforementioned range is applied to the electric thermal transducer, very minute bubbles are produced on the electric thermal transducer (immediately before film effervescence). A main heat pulse is then applied before the bubbles cease to exist. Then, the amount of ejection is decreased by the fact that the aforementioned very minute bubbles are disturbed by the effervescence caused by the main heat pulse. This area is called a pre-effervescence area. In this area, the control of the amount of ejection through the medium of the preheat pulse is attained with difficulty.

In FIG. 16, if the inclination of the straight line indicating the relation between the amount of ejection and the pulse width in the range of $P_1$=0 to $P_1$LMT [$\mu$s] is defined as the coefficient of dependency of the preheat pulse, then this coefficient of dependency of the preheat pulse will be represented as follows.

$$KP=\Delta V_{dp}/\Delta P_1 \ [p1/\mu\text{sec}\cdot\text{drop}]$$

This coefficient KP is determined by the head construction, drive conditions, and physical properties of ink and not by the temperature. To be specific, the curves b and c in FIG. 16 represent the data for other recording heads and indicate that the characteristics of ejection are changed when the recording head is changed. The upper limit $P_1$LMT of the preheat pulse $P_1$ varies when the recording head is changed as described above. Whenever the recording head is changed, the control of the amount of ejection is carried out with the upper limit $P_1$LMT which will be newly set for the new recording head.

On the other hand, the temperature of the recording head (the temperature of ink) is another factor which determines the ejection quantity of the ink jet recording head.

Figure 17:
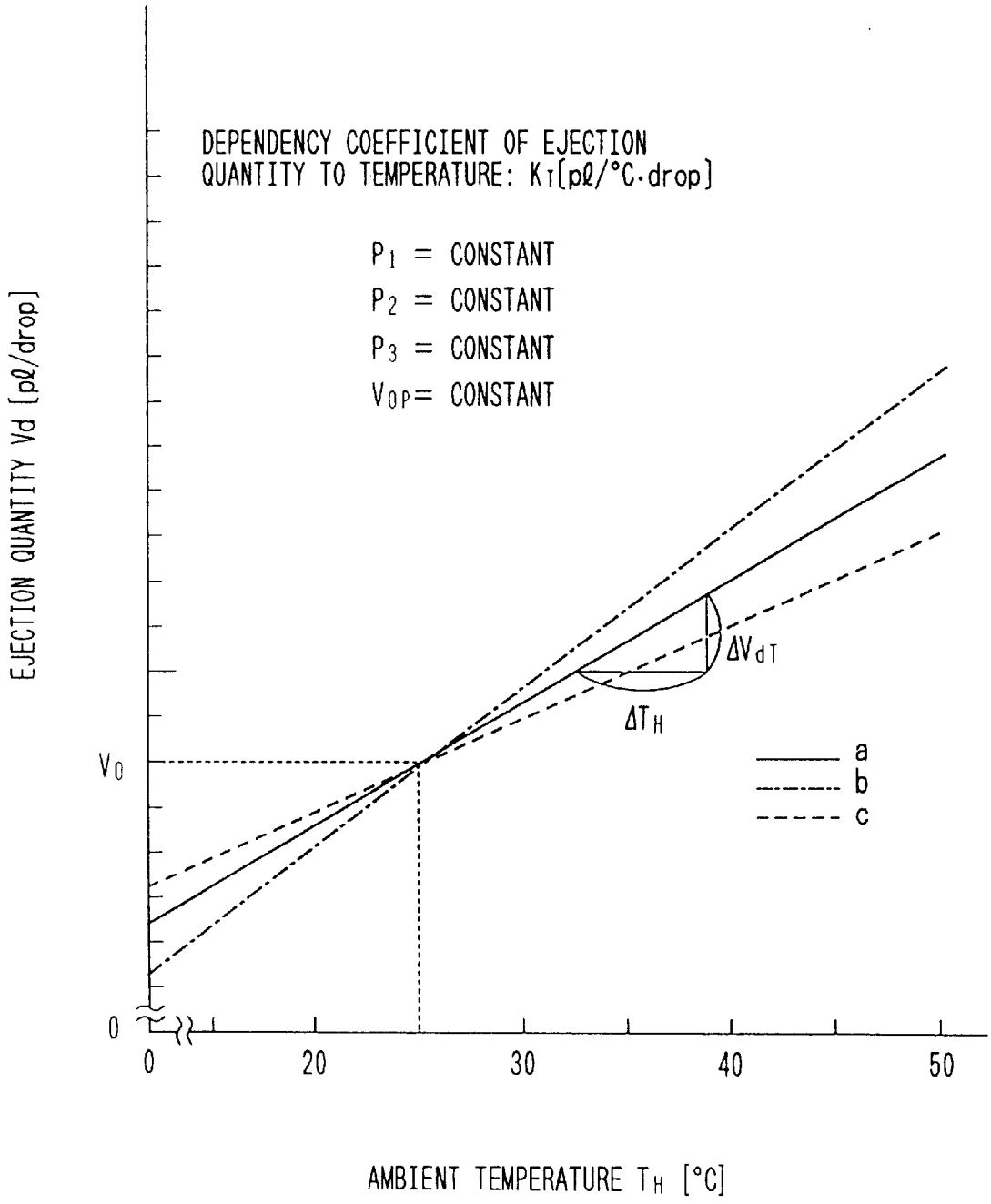
FIG. 17 is a diagram illustrating dependency of ejection quantity to a temperature.

FIG. 17 is a graph showing a temperature dependency of the ejection quantity. As shown with a curve a in FIG. 17, the ejection quantity $V_d$ linearly increases along with an increase of the ambient temperature TR of the recording head (=head temperature TH). If this linear gradient is defined as a temperature dependency coefficient, the temperature dependency coefficient is as given below:

$$KT=\Delta VdT/\Delta TH \ [pl/°\text{C.}\cdot\text{drop}]$$

This coefficient KT is determined by the construction of the head and properties of ink and not by the drive conditions. Also in FIG. 17, the ejection quantities of other recording heads are shown with curves b and c.

The control of ejection quantity according to the present invention can be carried out by using the relationships shown in FIGS. 16 and 17.

In the above example, PWM drive control with double pulses is described. However, the pulse can be multi-pulses such as, for example, triple pulses and the control can be a main pulse PWM drive system for which the width of the main pulse is modulated with a single pulse.

In this embodiment, the drive is controlled so that the PWM value is primarily set from a difference (ΔT) between the above-described target temperature and the head temperature. The relationship between ΔT and the PWM value is shown in FIG. 26.

In the drawing, "temperature difference" denotes the above ΔT, "preheat" denotes the above P1, "interval" denotes the above P2, and "main" denotes the above P3. "Setup time" denotes a time until the above P1 actually rises after a recording instruction is entered. (This time is mainly an allowance time until the rise of the driver and is not a value which shares an principal factor of the present invention.) "Weight" is a weight coefficient to be multiplied with the number of print dots to be detected to calculate the head temperature. In printing the same number of print dots, there will be a difference in the rise of head temperature between printing in the pulse width of 7 $\mu$s and printing in the pulse width of 4.5 $\mu$s. The above "weight" is used as means for compensating the difference of temperature rises along with modulation of the pulse width according to which PWM table is selected.

(Overall Flow Control)

Figure 27:
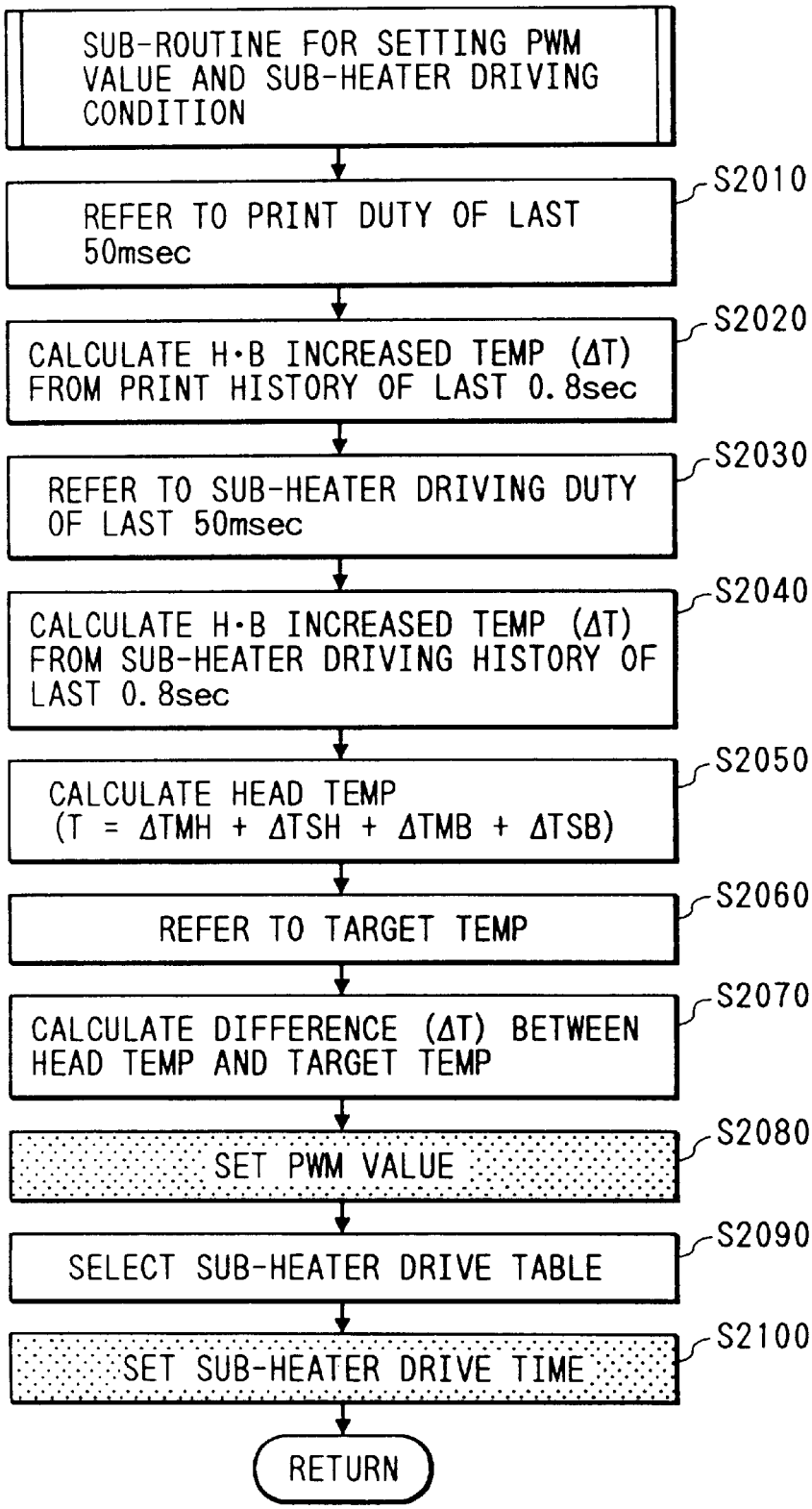
FIG. 27 is a flowchart illustrating a routine for setting a PWM value and a sub-heater driving condition.
Figure 28:
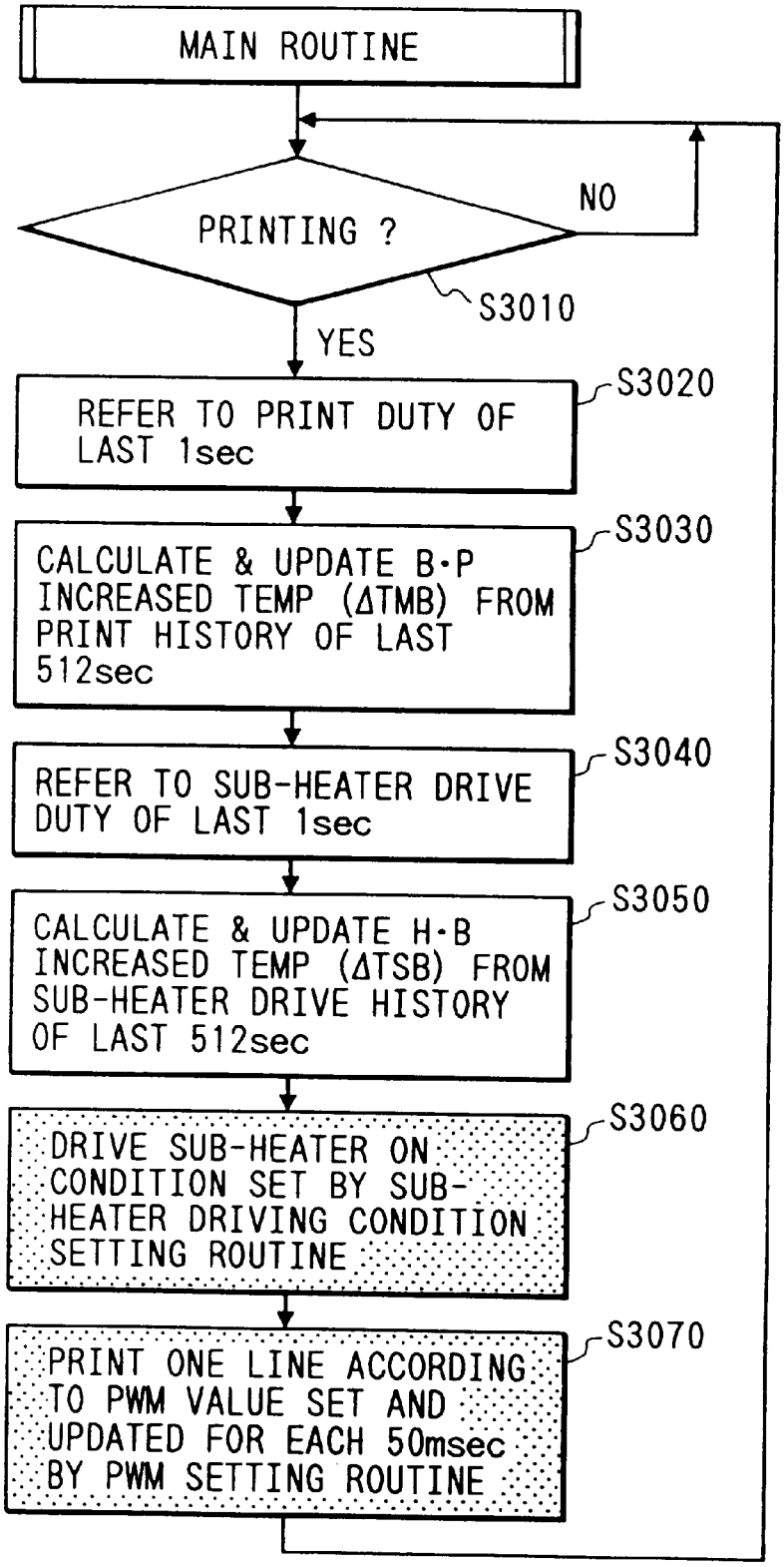
FIG. 28 is a flowchart illustrating a main routine.

The flow of the control system as a whole is described, referring to FIGS. 27 and 28.

FIG. 27 shows an interrupt routine for setting the PWM drive value and a sub-heater drive time for ejection. This interrupt routine occurs every 50 m sec. The PWM value and the sub-heater drive time are always updated every 50 m sec, regardless that the printing head is printing or idling and the drive of the sub-heater is necessary or unnecessary.

If the interrupt of 50 m sec is ON, the printing duty for 50 m sec shortly before the interrupt is referred (S2010). However, the printing duty to be referred to in this case is represented by a value obtained by multiplying the number of dots for which ink has been actually ejected by a weight coefficient for each PWM value as described in (PWM control). From the duty for this 50 m sec and the printing history for the past 0.8 seconds, the temperature rise (ΔTmh) of a group of components for which the heat source is the ejection heater and the time constants are of a short range is calculated (S2020). Similarly, the drive duty of the sub-heater for 50 m sec is referred to (S2030), and the temperature rise (ΔTsh) of a group of components for which the heat source is the ejection heater and the time constants are of a short range is calculated from the drive duty of the sub-heater for 50 m sec and the drive history of the sub-heater for 0.8 seconds (S2040). Then the head temperature is calculated by referring to a temperature rise (ΔTmb) of a group of components for which the heat source is the ejection heater and the time constants are of a long range and a temperature rise (ΔTsb) of a group of components for which the heat source is the sub-heater and the time constants are of a long range, which are calculated in the main routine, and adding up these values of temperature rises (=ΔTmh+ΔTsh+ΔTmb+ΔTsb) (S2050).

A target temperature is set from the target temperature table (S2060) and a difference (ΔT) between the head temperature and the target temperature is obtained (S2070). A PWM value which is an optimum head drive condition in response to ΔT is set from the temperature difference ΔT, the PWM table and the sub-heater table (S2080). A sub-heater drive time which is an optimum head drive condition in response to the temperature difference ΔT is set (S2100) according to the selected sub-heater table (S2090). Up to the above, the interrupt routine is finished.

FIG. 28 shows the main routine. When the print instruction is entered in step 3010, the printing duty for the past one second is referred to (S3020). The printing duty is a value obtained by multiplying the number of dots for actual ejection by the weight coefficient for each PWM value as described in (PWM Control). A temperature rise (ΔTmb) of a group of components for which the heat source is the ejection heater and the time constants are of a long range is calculated from the printing history in the duty of one second and the past 512 seconds and stored as updated at a specified location of the memory (S3030) so that it can be easily referred to for the interrupt of every 50 m sec. Similarly, the drive duty of the sub-heater for one second is referred to (S3040), and a temperature rise (ΔTsb) of a group of components for which the heat source is the sub-heater and the time constants are of a long range is calculated from the printing history in the duty of one second and the past 512 seconds. As in the case of the temperature rise ΔTmb, the temperature rise ΔTsb calculated as above is stored as updated at a specified location of the memory so that it can be easily referred to for the interrupt of every 50 m sec (S3050).

Printing and driving of the sub-heater are carried out according to the PWM value and the sub-heater drive time which are updated upon each entry of the interrupt of 50 m sec.

In this embodiment, PWM of double pulse and single pulse are used for controlling ejection quantity and head temperature; PWM of triple pulses or more pulses may be used.

Even when the head is driven at a head tip temperature higher than a printing target temperature and PWM of a small energy, if the head tip temperature is unable to be reduced, the scanning speed for a carriage may be controlled, or the scanning start timing for the carriage may be controlled.

<Measurement of head characteristics>

Figure 13:
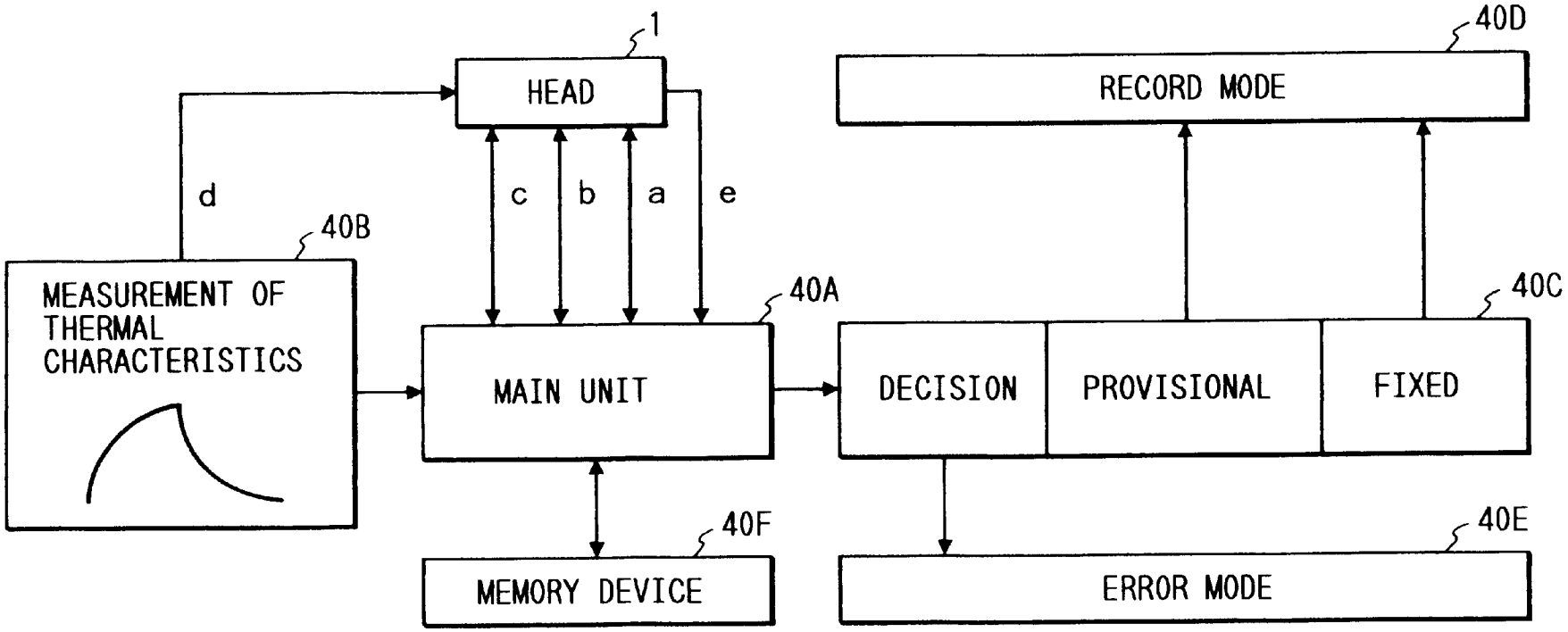
FIG. 13 is a block diagram illustrating measurement of head characteristics.

For optimum head drive as stated before, the main unit of a recording apparatus should identify various characteristics of a recording head. Moreover, in this embodiment, since a recording head 1 is in a replaceable fashion, the above mentioned head characteristics are measured without fail at head replacement. Items of measurement are the following four:

1) Ejection heater characteristics (dummy heater resistance value)
2) Diode sensor characteristics (diode sensor output)
3) Sub-heater thermal characteristics
4) Ejection heater thermal characteristics FIG. 13 shows a schematic diagram of measurement of head characteristics. This embodiment shows that head characteristics measured by a main unit are the above mentioned four items. In FIG. 13, a represents the measurement of ejection heater characteristics, b represents the measurement of Di sensor characteristics, c represents ejection heater characteristics, and d represents sub-heater thermal characteristics. There exist inputs and outputs, such as energy application, the measurement of temperature, etc., between a main unit 40A and a head 1, and a decision 40C on individual head characteristics is made on the basis of the results of the measurement 40B. Then, a definition as provisional or fixed may be made. On completion of deciding head characteristics, a record mode 40D is entered for becoming ready for recording. If the results of measurement of head characteristics are abnormal, an error mode 40E is entered, and the main unit 40A indicates an error. Individual head characteristic values are stored in a memory device 40E. The stored values are used to determine whether a head has been replaced or the same head as that used previously is used.

Individual head characteristics are hereinafter described in detail.

First, for ejection heater characteristics, a dummy resistance 20E (FIG. 9) is measured. When constant-voltage driving is used for driving a printing head, how much energy is to be applied is known from the resistance value of an ejection heater. In this embodiment, a drive voltage application time is variable in correspondence with a dispersion in the resistance value of the ejection heater for optimum drive. In other words, a PWM table as shown in FIG. 26 is provided for each ejection heater characteristic (head rank).

Secondly, diode sensor characteristics are measured. An ambient temperature is measured by a thermistor built in the main unit of a recording apparatus. A diode sensor reference output voltage and a temperature-output voltage characteristic (gradient value) at a reference temperature (for example, 25° C.) is previously known. Hence, a diode sensor output voltage at the above mentioned ambient temperature is converted to that at the reference temperature (25° C.), thereby measuring characteristics of a diode sensor by comparison with the diode sensor reference output voltage. Since the output of the diode sensor depends on a head temperature, characteristics of the diode sensor cannot be measured when a recording head is different in temperature from a main unit temperature or when sharp temperature changes exist. In such a case, it is needed to wait until the thermal stability is established.

If, however, the recording head is considered as a new one, it may have been left in an environment whose temperature is extremely different from that of an environment in which the main unit is installed, accordingly, to measure its diode rank, a considerable waiting time is needed after the recording head is mounted on the main unit.

This is because the new recording head provides a large thermal time constant until it is adjusted to the temperature of the environment in which the main unit is installed, since the entire head has been adapted to the previous ambient temperature; it is noticeable if the entire recording head portion has a large thermal capacity. For example, if ink tanks and a recording head are integrated, its head temperature will not be easily stabilized since ink and ink tanks have a large thermal capacity. In addition, if a plurality of recording heads constitute a single head as described in this embodiment, air within a frame of the recording heads acts as a large thermal capacity, therefore, it becomes still harder to stabilize the head temperature; it may take approximately one hour until the temperature is stabilized.

Accordingly, if its diode rank is measured without waiting for a sufficient time, the temperature of the recording head sometimes cannot be obtained precisely due to a large measurement error of its rank value. It also sometimes leads to impossibilities of stabilization such as stable ink ejection from a recording head and stable ejection quantity. To solve this problem, the diode rank is presumed by estimating the temperature of a recording head from changes of values during a fixed time observed on diode sensors of the recording head and a thermistor temperature in the main unit during the time.

Thirdly, thermal characteristics of a sub-heater are measured. The sub-heater functions to maintain a head temperature at a constant level (for example, 25° C.) for preventing ink ejection characteristics from deteriorating at low temperatures. As mentioned above in the paragraph of a head temperature calculation algorithm, the main body of the recording apparatus has a calculation table for the sub-heater for temperature calculation. This calculation table contains temperature changes of the printing head at a constant interval of time (way of heat transmission as viewed from a Di sensor). In actuality, the way of joining between members of a printing head, an ejection quantity, a dispersion in a main unit power supply for heater drive, etc. cause the contents of the calculation table to vary for each printing head. In this embodiment, temperature changes are divided into three patterns for easy-to-accumulate-heat printing heads through hard-to-accumulate-heat heads, and corresponding three calculation tables mentioned above are provided.

For easy-to-accumulate-heat heads, because of high increased temperatures, values in the table are rather large even when an identical energy (duty) is applied. On the contrary, for hard-to-accumulate-heat heads, because of quick radiation of heat, values in the table are rather small. A center table 2 indicative of central conduction of heat for printing heads is provided between a large-temperature-change table 3 (easy to accumulate heat) and a small-temperature-change table 1 (hard to accumulate heat).

Figure 12:
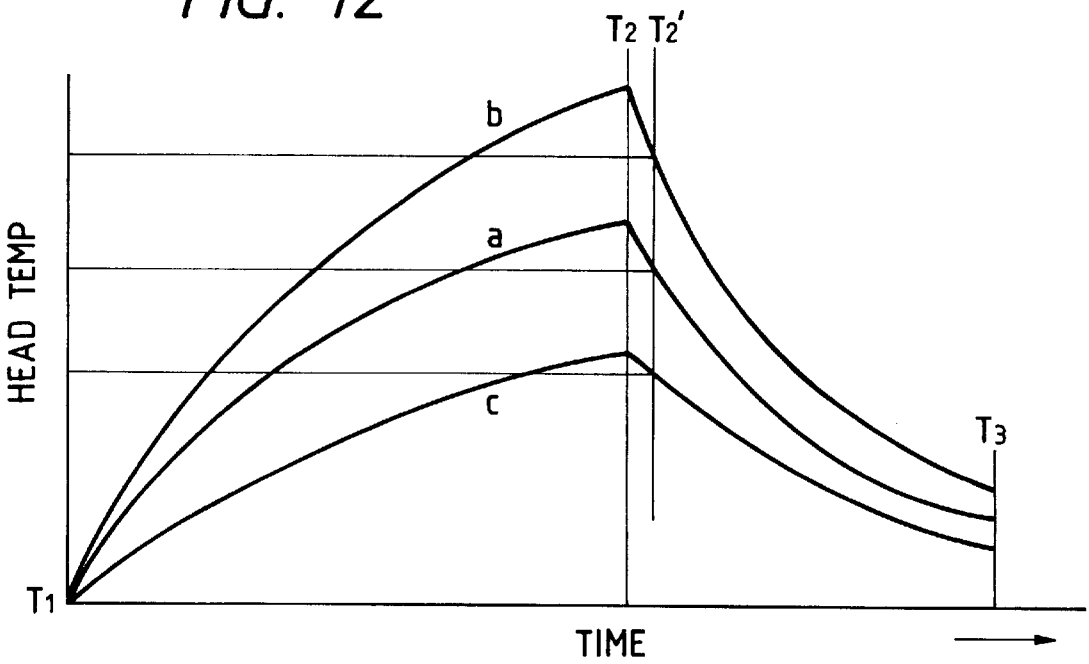
FIG. 12 is a diagram showing a head raise or downward movement at measuring thermal characteristics of a sub-heater.

Measurement of sub-heater thermal characteristics is intended to select a table. FIG. 12 shows an increase/decrease of temperature for each thermal characteristic at application of an identical energy. A diagram a represents a central increase/decrease of temperature, a diagram b represents an increase/decrease of temperature for the case of high increased temperatures due to large accumulation of heat, and a diagram c represents the one for the case of low increased temperatures due to small accumulation of heat. First, temperature is measured at a timing T1 before applying energy. Next, temperature is measured at a timing T2 before/after completion of applying energy. Finally, temperature is measured at a timing T3 after reduction of temperature. At this time, a measurement value for selecting a table is calculated as follows:

Measurement value=2×(temperature at T2)−(temperature at T1)−(temperature at T1)

When a target printing head is easy to accumulate heat, a measurement value will be greater than a threshold 2; hence, the large-temperature-change table 3 is selected as a calculation table. On the contrary, if a measurement value is smaller than a threshold 1, the small-temperature-change table 1 is selected on the assumption that a head is hard to accumulate heat. Also, if the above mentioned measurement value falls between the threshold 1 and the threshold 2, the center table 2 is selected on the assumption that a head is a standard printing head.

Table 1: measurement value<threshold 1

Table 2: threshold 1<measurement value≦threshold 2

Table 3: threshold 2<measurement value

In this embodiment,

T2−T1=T3−T2 is taken, but this is not necessarily the one to stick to, depending on a threshold employed.

As explained above, setting a calculation table for each printing head thermal characteristic allows calculation at a higher precision as compared with a method using uniform thermal characteristics, and provides beneficial effects including a low calculation load.

Fourthly, thermal characteristics of an ejection heater are measured. The operation of measurement is identical to that for the above mentioned method for measuring sub-heater thermal characteristics, but what is driven is the ejection heater.

In this embodiment, for measurement items of head characteristics, 1) priority is set,
2) a once measured characteristic value is digitized (divided into ranks) and stored, and
3) a stored characteristic value is compared with a newly measured characteristic value. As a result, an identification (ID) of a recording head itself can be set, thereby reducing the time of measurement of head characteristics and improving efficiency of measurement.

First, measurement values of an ejection heater and a diode sensor are divided into ranks for management. This method allows the easy handling of measurement values for comparison with previous measurement values and for storing/saving in the main unit of a recording apparatus.

<Ejection heater characteristics>

Ejection heater characteristics, as mentioned before, are represented with a dummy resistance 20E. In this embodiment, explained is the case where a dispersion of the dummy resistance 20E is 272.1 Ω±about 15%. As shown in FIG. 3, a dispersion of resistance values is divided into 13 ranks. A center value is taken as rank 7, and the width of a resistance value within one rank is about 8 Ω, about 2.3% of an overall dispersion. Division into finer ranks allows head rank setting at a higher precision, but requires a read circuit of a higher precision on the main unit side of the recording apparatus. After the recording apparatus has read head ranks, when the read head ranks are written to memory members (EEPROM, NVRAM, etc.), the above mentioned numbers 1 to 13 are stored for each of four heads.

<Diode sensor characteristics>

As in the case of the aforementioned head ranks, characteristics of a diode sensor (hereinafter referred to as Di sensor) are also divided into ranks for similar reasons. Among Di sensors, there exists not so much a dispersion in a coefficient of proportion (hereinafter referred to as gradient) for temperature-output voltage (when used for head temperature management in this embodiment); however, offsets (dispersion of output values at the same temperature) disperse considerably among sensors. Hence, even when an identical output voltage is obtained, an absolute value of a head temperature is unknown unless Di sensor characteristics (ranks) are known.

Figure 4:
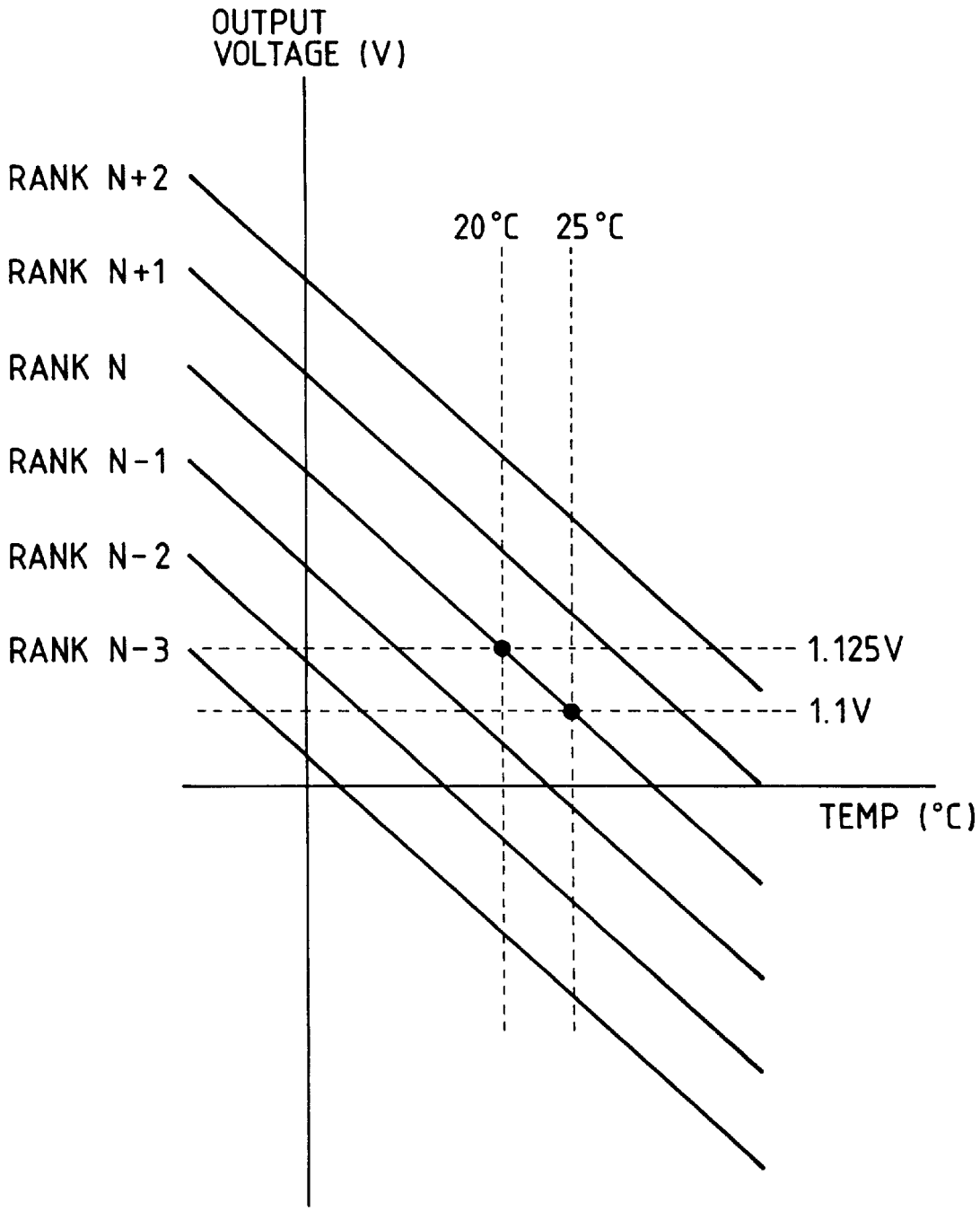
FIG. 4 is a diagram illustrating a relationship between a Di sensor temperature and an output voltage.

FIG. 4 illustrates Di sensor ranks. Taking temperature along the axis of abscissa and the output voltage of a Di sensor along the axis of ordinate, FIG. 4 diagrams center values of each rank. In actuality, a voltage value having a width is in contact with that of an adjacent rank for each rank. Assume that an output is 1.125 V when the Di sensor of a certain head is at 20° C. (when a thermistor temperature is considered identical to a head temperature, a correction is made so that the thermistor temperature agrees with a Di sensor temperature). As mentioned before, a gradient is substantially constant, and in this embodiment, the gradient is as follows:

−5.0 [mV/°C.]

Hence, an output voltage converted to that at 25° C. is 1.1 V. Thus, the output voltage value of a Di sensor is converted to that at an ambient temperature of 25° C. by using a gradient value, and the converted value is compared with a previously prepared conversion table for determining a rank. Di sensors in this embodiment have the following dispersion of output voltage at 25° C.

1.1±0.05 [V]

Hence, from the aforementioned gradient value of −5.0 mV/°C., a dispersion of ±10° C. occurs at the same output voltage. Therefore, with a total number of ranks being set to 10, a temperature dispersion in one rank is 2° C., and with 20 ranks set, the same is 1° C. The above mentioned number of ranks is determined at a precision required for head temperature management. However, as the number of division ranks increases, the detection width for a divided voltage becomes accordingly narrower; hence, the precision of a detection circuit needs to be accordingly higher. Thus, ranks for ranked Di sensors are stored for each color head.

<Presuming Diode Sensor Rank>

Figure 1:
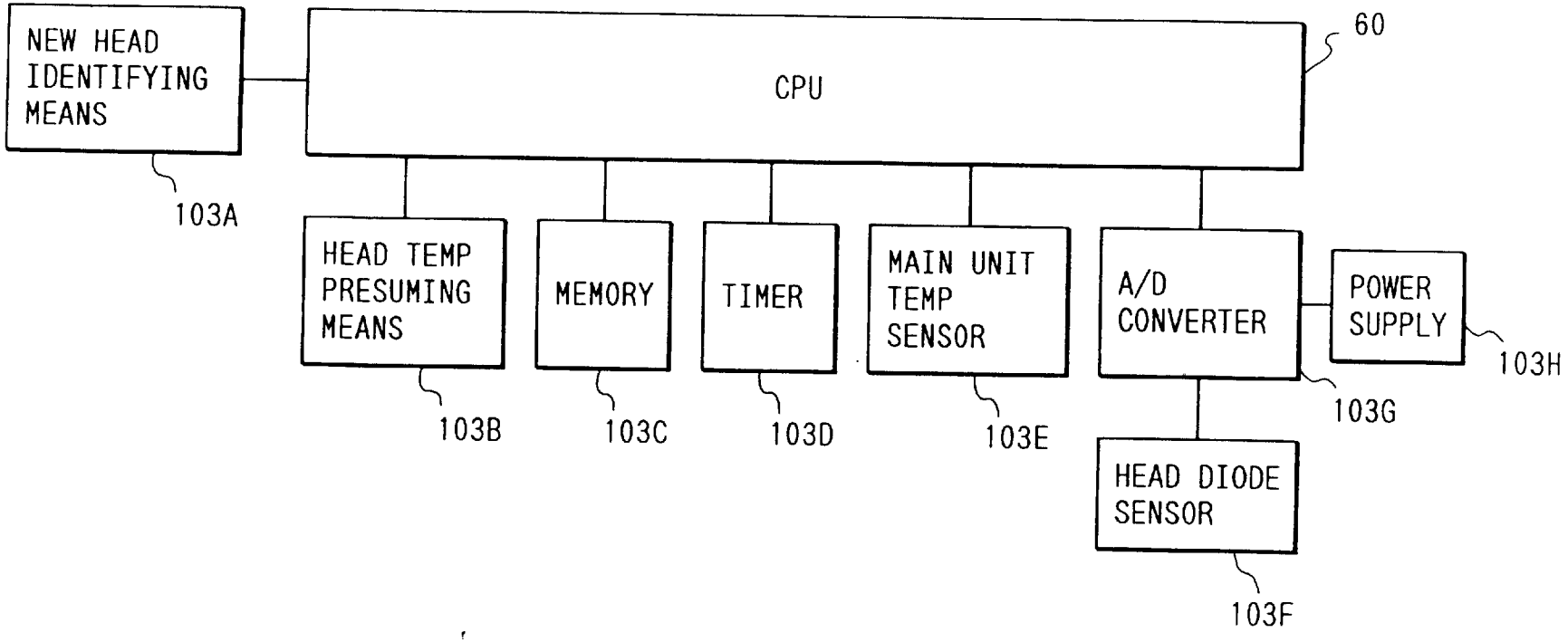
FIG. 1 is a block diagram illustrating a diode rank presuming operation according to the first embodiment.

Referring now to FIG. 1, there is shown an entire configuration for presuming diode sensor ranks. If it is considered that a new recording head is fitted (103A), characteristics of a diode sensor are not measured directly, but they are presumed. More specifically, a temperature Ts of the recording head is measured and stored first, on the assumption that the diode sensor rank is considered as a standard value (103C, 103F, 103G, and 103H). Second, a temperature T of the recording head is measured again after an elapse of a fixed time t (103D). At the same time, a room temperature T0 in the main unit is measured by a thermistor (103E).

Referring now to FIG. 29 for description of the above, temperature values of the recording head converge to an ambient temperature (room temperature) at a certain time constant like exponential functions (Expression 1). The temperature to which the temperature values are converged can be obtained from Expression 2.

$$T = (Ts - T0) \cdot \exp(-t1/tj) + T0 \quad \text{(Expression 1)}$$

$$T0 = (T - Ts)/(1 - A) + Ts = \Delta T/(1 - A) + Ts \quad \text{(Expression 2)}$$

$$(\Delta T = T - Ts,\ A = \exp(-t1/tj),\ tj: \text{Time constant})$$

The diode rank is determined so that T0 obtained from this expression matches the thermistor temperature. Since time constant tj is great compared to a head immediately after printing, t1 and A are set to 30 sec. and 0.94, respectively, in this embodiment.

<Characteristics of Sub-heater and Ejection Heater>

For characteristic values of a sub-heater and an ejection heater, the above-described calculation table numbers are stored as rank values of these heaters.

Figure 5:
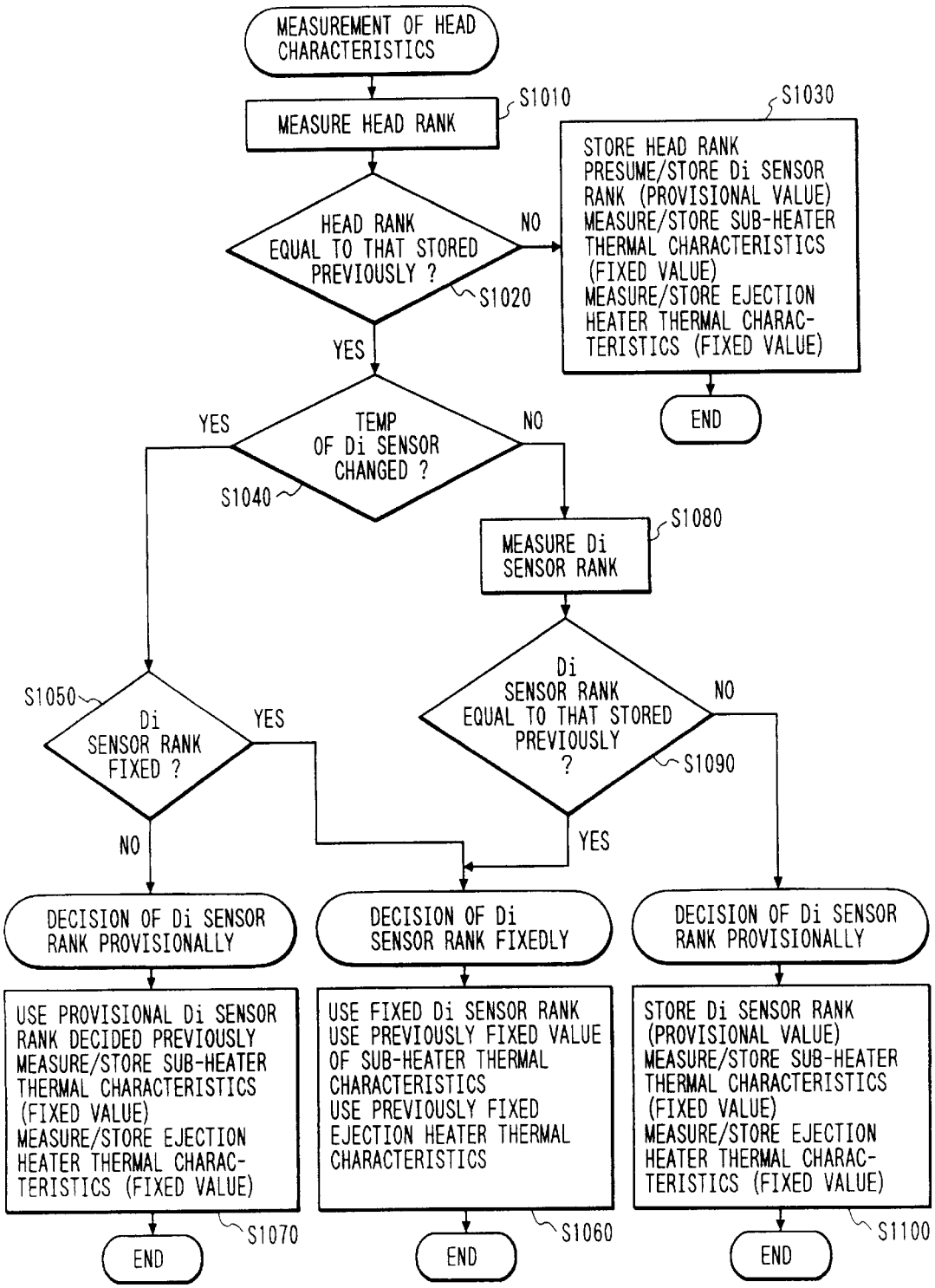
FIG. 5 is a flowchart illustrating a head characteristics measuring sequence according to the first embodiment.

Referring to FIG. 5, there is shown a flow of a head characteristics measurement sequence. Head ranks are measured in step S1010 first, and if they are not identical, it is determined that a different head is installed, in step S1020. The head characteristics are measured for all heads whether or not there are any temperature changes in the vicinity of Di sensors. In step S1030, diode (Di) sensor ranks are presumed and then stored as provisional values.

If head ranks are determined to be identical in step S1020, it is checked that there are any changes in temperatures of the Di sensors, in step S1040. Since the Di sensors can sense temperature changes even if their rank values are not determined, it is determined whether the temperatures in the vicinity of the Di sensors are stable by checking a temperature variance within a fixed time.

In this embodiment, a presence of a change of 0.2° C. or more in 10 sec. is defined as a temperature change. This is because a temperature change can be fully confirmed by a change in 10 sec. since a temperature change is large due to a smaller thermal time constant immediately after printing, contrary to the diode rank determination. If it is determined that a temperature change is present in step S1040, this condition is not suitable for the Di sensor rank measurement, therefore, the measurement (output voltage measurement) is omitted, and a previous Di sensor rank value is used in step S1060. At this time, the rank value is determined whether it is provisional or fixed. If the previous Di sensor rank is a fixed value in step S1050, the installed recording head is determined to be the same as one at the previous characteristics measurement, and the previous characteristics value is used.

If it is a provisional value in step S1050, this provisional value is used in step S1070. Since the Di sensor rank value is provisional, the previous values can be also used for thermal characteristics of sub-heaters and ejection heaters or the previous central table value can be used as a provisional value, though thermal characteristics of sub-heaters and ejection heaters are measured again in this embodiment. In this case, temperature changes in the vicinity of the previous printing heads will not affect the measurement of the thermal characteristics of the sub-heaters and ejection heaters. The characteristics of the heads, however, must be measured again as soon as possible due to a use of the provisional value.

If it is determined that there is no temperature change in step S1040, the Di sensor ranks can be measured in a short time, therefore, they are measured in step S1080. If the measured values are the same as the previously-stored values when they are compared each other in step S1090, the Di sensor ranks are determined to be fixed and the heads are identical with the previous ones, and the previously-stored values are used for the thermal characteristics of the sub-heaters and ejection heaters in step S1060. If the measured values are not the same as the previous values in the comparison in step S1090, the Di sensor rank values are determined to be provisional and the heads are different from the previous ones, and then the thermal characteristics of the sub-heaters and ejection heaters are measured again in step S1100.

As described in the above, if it is determined that a new recording head is installed, its diode rank is presumed. This makes it possible to fit the diode rank relatively in a short time and precisely even if the installed recording head has been placed in an environment whose temperature is extremely different from that of the environment where the main unit is installed. Accordingly, even if this rank value is provisional, the recording head temperature value is reliable and it is different from a usual provisional value. For this reason, stable ink ejection from recording heads and their ejection quantity can be achieved by changing driving conditions according to head temperatures obtained afterward.

As described in the above, a precise rank measurement can be achieved by determining whether the above rank measurement is performed according to a presence of any temperature changes of the Di sensors prior to the Di sensor rank measurement. Furthermore, the combination of the provisional and fixed characteristic values makes it possible to apply precise values to ranks even if the sensors are placed in unsuitable conditions for the Di sensor rank measurement due to a temperature change in the above. If the head ranks are identical with the previous ones and the Di sensor ranks are fixed values, the previous stored values can be used for respective head characteristics independently from temperature changes.

In this embodiment, after completing the aforementioned measurement of head characteristics, the remeasurement of head characteristics is conducted. At ordinary start-up of a recording apparatus (when the aforementioned measurement of head characteristics is to be conducted without fail), central characteristic values like provisional values, etc. are used to shorten the above mentioned start-up time for making the recording apparatus ready to use. Then, the above mentioned remeasurement of head characteristics (hereinafter referred to as correction of head characteristics) is made while the recording apparatus is not used by a user, for deciding more accurate fixed values from head characteristic values used as provisional values, thereby improving the precision of head control.

Figure 6:
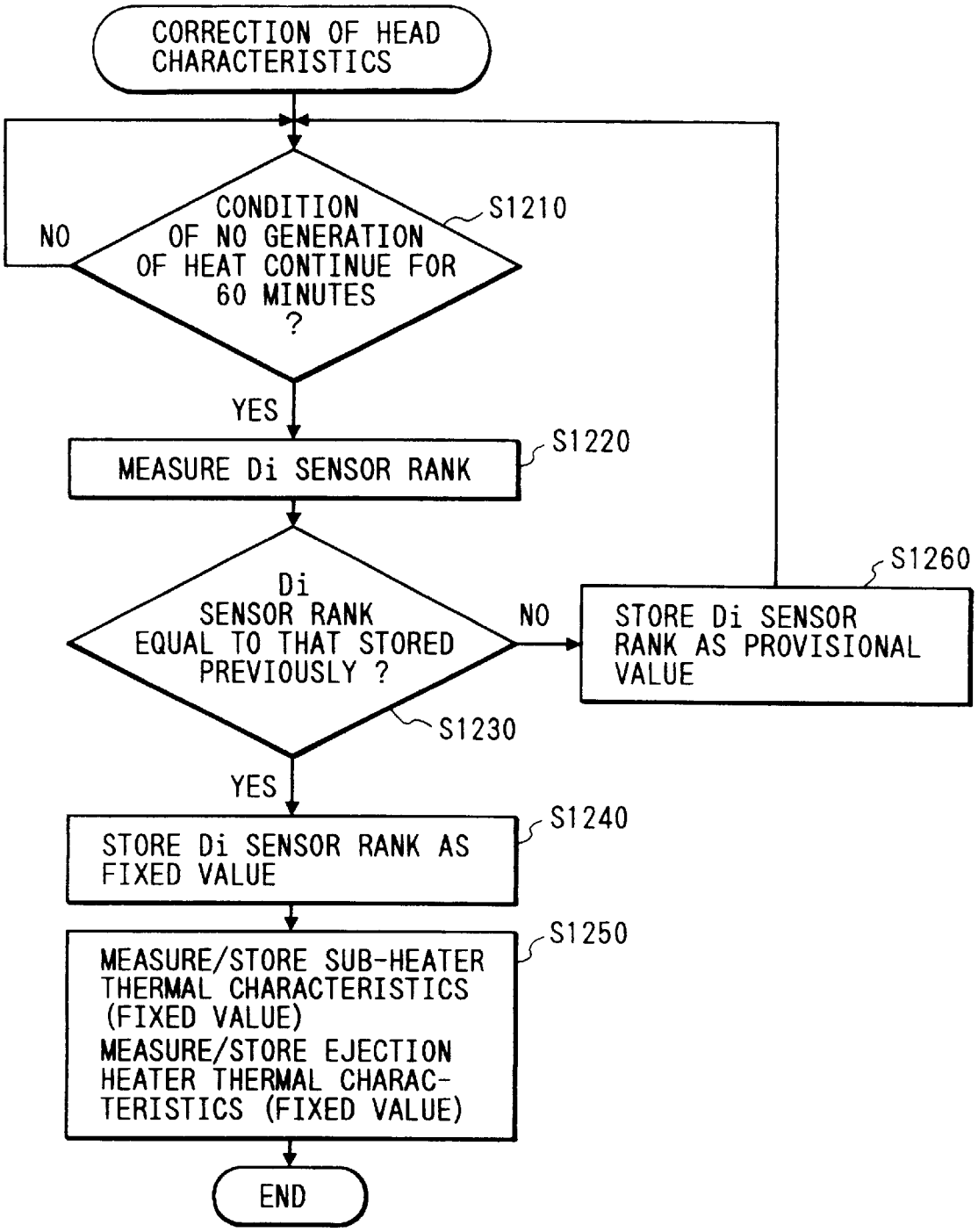
FIG. 6 is a flowchart illustrating another head characteristics measuring sequence according to the first embodiment.

This is flow charted in FIG. 6. In this embodiment, a Di sensor rank is measured after no generation of heat has continued for 60 minutes at a recording head of the recording apparatus. This generation of heat is that when an ejection heater or a sub-heater is driven. Hence, when neither of the ejection heater and the sub-heater have been driven for the last 60 minutes at step S1210, this is interpreted as no generation of heat, and the measurement of a Di sensor rank is executed at step S1220 on the assumption that there is no change in temperature near a recording head. The reason why this embodiment employs a time of no generation of heat of 60 minutes is, as shown in FIGS. 10 and 11, that a plurality of (four) recording heads are integrated into one unit and that a carriage 3 wherein the recording heads are positioned and fixed, does not have sufficient space to groove for heat radiation. The length of the above mentioned time depends on the form of the heads and the carriage or a required precision of a Di sensor rank.

Next, at step S1230, a measured Di sensor rank value is compared with a previously stored value, and if they are equal to each other, the measured Di sensor rank is stored as a fixed value at step S1240. At step S1250, sub-heater/ejection heater thermal characteristics are remeasured using the fixed value, for storing the measured thermal characteristics as final recording head characteristic values. If the above mentioned measured Di sensor rank is found unequal to that stored previously, the measured Di sensor rank is stored as a provisional value at step S1260, and then, a sequence of waiting for a 60-minute continuation of no generation of heat is again entered.

In FIG. 6, when a Di sensor rank is fixed once and sub-heater/ejection heater thermal characteristics are measured, the above mentioned correction of head characteristics is completed. A routine may be such that after fixing a Di sensor rank and then completing the measurement of sub-heater/ejection heater thermal characteristics, a return to the initial sequence of waiting for a 60-minute continuation of no generation of heat is made for repeating the operation of correction.

Further in this embodiment, it is determined whether the ranks or heads are identical with the previous ones by setting an allowable range for the ranks which are the previous head characteristic values. For example, when the previous head characteristics are measured, the highest priority is given to reduction of a starting time for the recording apparatus so as to be usable, and the heads and ranks (sub-heaters and ejection heaters of Di sensors) are determined to be identical with the previous ones only if the difference is within ±2 ranks. Accordingly, the heads can be determined to be identical with the previous ones even if there is a variation in measurements by setting a criterion with some allowance, and the past stored values are used, so that the starting time can be reduced. When head characteristics are corrected, the highest priority is given to preciseness, and the allowance for identical ranks is set to a range within ±1 rank. Narrowing the allowance range in this way makes it possible to set more precise rank values of the characteristics when they are determined to be fixed. Allowance ranges for precision used like this are not limited to the above values, if necessary.

As described in the above, according to this embodiment, characteristics of the thermal sensors of a new recording head are presumed by detecting that the new recording head is installed, therefore, the characteristics of the thermal sensors can be obtained precisely and in a short time.

In addition, in this embodiment, reduction of a starting time for the recording apparatus and higher precision for measurements of head characteristics can be achieved due to the following:

1) using head characteristic values as ID of a recording head,
2) defining head characteristic values as provisional or fixed values,
3) determining whether head characteristics are to be measured according to a thermal status of a recording head, and
4) using an allowable range for ranks at correcting head characteristics, which is different from a range used at a normal start of the apparatus.

2nd Embodiment

Referring to FIG. 30, another embodiment is described below for a diode rank presuming method which has been described in the 1st embodiment. A temperature of a recording head has noise elements as shown in FIG. 30 also when printing is not performed. Accordingly, the noise elements are removed by measuring an average temperature in approx. one sec. at 50 ms intervals when $T_s$ and T are measured. This makes it possible to shorten sampling intervals $T_s$ and T and to improve the precision of diode rank values at the same sampling intervals.

3rd Embodiment

Figures 31A, 31B, 31C, 31D:
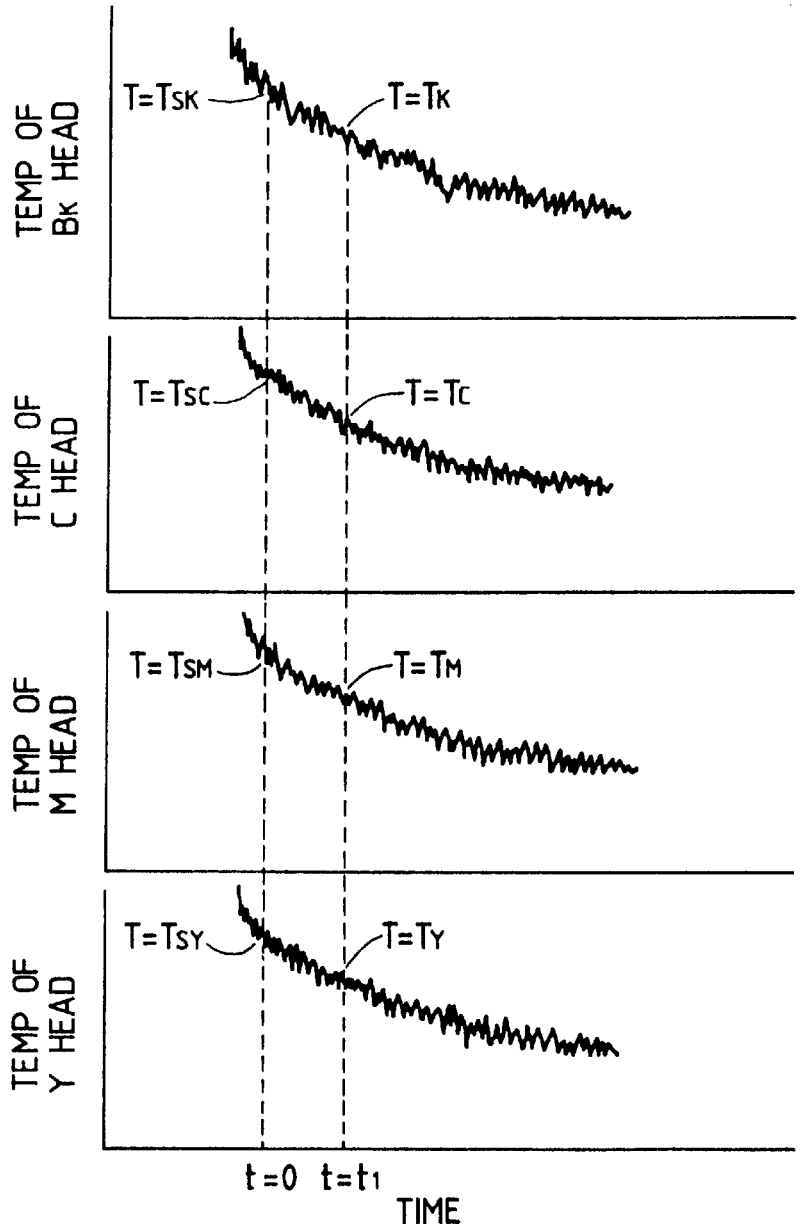
FIGS. 31A–31B are graphs describing the third embodiment.

Another embodiment is described below for a method of achieving a higher precision for diode rank values in the same way as for the 2nd embodiment. Referring to FIG. 31, if a recording head consists of a plurality of heads integrated in a frame and it is considered as a new head, all the heads have been placed in a common environment.

Accordingly, after an average of temperature $T_s$ of a plurality of the recording heads is measured at almost the same timing, t=0, an average of a plurality of the recording heads is measured at almost the same timing, t=t1 again, and then T0 is presumed by calculating a difference between them, ΔT to determine the diode rank.

4th Embodiment

An object of this embodiment is to reduce an error of a presumed diode rank when an LED or the like is set in the 1st embodiment. The diode rank presumption in the 1st embodiment is performed when a plug of the main unit is put in an outlet. At this time, a user has not turned on a soft power switch yet, therefore, there is no indication with the LED and the main unit looks as if it should not be started. The main unit, however, is practically under an operation of the diode rank presumption and temperatures of the recording heads are being measured. Unless the soft power switch is turned on afterward, the diode rank assumption will be completed to the end. In this embodiment, however, the LED is lit to indicate the operation when the soft power switch is turned on, and if the temperature presumption of the recording heads is not completed, a diode rank presumption is started anew.

A reason for this is described below. When the LED is lit by depressing the soft power switch, a voltage of the power supply is lowered to some extent since a large amount of the current is carried for lighting the LED, so that a measured value of the recording head temperature becomes smaller a little as shown in FIG. 32. Since a temperature change ΔT is greater than an actual one due to it, the result of calculation for the diode rank presumption has a variation. Accordingly, to prevent the variation, the temperature measurement of the recording head is restarted from the beginning when the LED is lit, and this leads to precise measurement of ΔT.

The downward movement of the temperature measurement due to lighting the LED is approx. 0.5° C. which is a change level having no difficulty for a normal control. For presuming diode ranks, however, a presumed temperature has an error of 8.3° C. when ΔT is 0.5° C. in this embodiment since A becomes 0.94. If the driving control is based on a presumed temperature having such an extreme error, it is difficult to assure stable ink ejection or ejection quantity.

Figure 2:
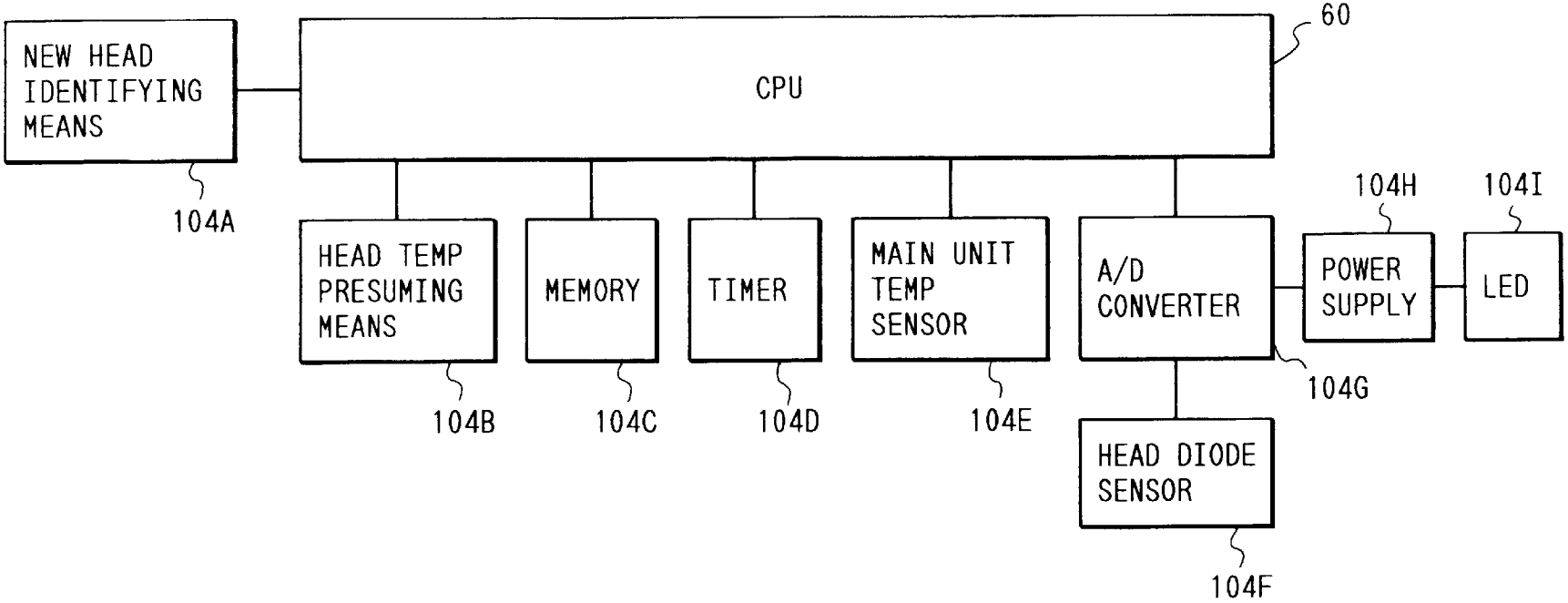
FIG. 2 is a block diagram illustrating a diode rank presuming operation according to the fourth embodiment.

Referring to FIG. 2, there is shown a general structure of this embodiment. It is different from FIG. 1 illustrating the structure of the 1st embodiment in respect of LED 104I connected to power supply 104H.

5th Embodiment

If an LED periodically flickers to indicate an operation during the recording head temperature measurement while a diode rank is being presumed, the recording head temperature changes with the same period as for the LED flickering as shown in FIG. 33. Then, the same problem as for the 4th embodiment may occur, therefore, a practical temperature change ($\Delta T$) must be acquired precisely by removing the temperature change due to the LED flickering.

In this embodiment, the temperature change due to the LED flickering is removed by measuring an average value of the recording head temperature in units of a time interval which is a half of an LED flickering period as shown in FIG. 33. An average of the temperatures in one LED flickering period is measured as shown in FIG. 33 in this embodiment.

As described in the above, the present invention provides precise and short-time measurement of characteristics of the temperature sensors by detecting that a new recording head is installed and presuming the characteristics of the temperature sensors of the recording head, so that it makes it possible to improve an image quality of the ink jet recording apparatus and to increase the throughput at a lower cost.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disclosed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670 wherein a common slit is used as the ejection outlet for plural electrothermal transducers, and to the structure disclosed in Japanese Laid-Open Patent Application No. 59-138461 wherein an opening for absorbing pressure waves of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressurizing or suction means, and preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in a usual recording apparatus of this type, the ink may be such that it is liquid within the temperature range when the recording signal is applied, but the present invention is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases, upon the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 54-56847 and Japanese Laid-Open Patent Application No. 60-71260. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus having a recording head mounted thereon for recording, said recording head comprising means for generating thermal energy for recording and a temperature sensor for outputting an output value corresponding to detected temperature, said apparatus comprising:

mounting means for removably mounting a mounted recording head;

head detecting means for detecting that said mounted recording head has been replaced on said mounting means with a replacement recording head;

presuming means for presuming characteristics of said temperature sensor of said replacement recording head mounted on said mounting means based on a time-based change of the output value from said temperature sensor when replacement of said mounted recording head is sensed by said head detecting means; and correcting means for correcting a value based on the output value from said temperature sensor by processing data including the characteristics presumed by said presuming means.

2. An apparatus as set forth in claim 1, wherein said correcting means corrects the value based on the output value of said temperature sensor by at least initially processing said presumed characteristics.

3. An apparatus as set forth in claim 1, further comprising characteristic detecting means for detecting the characteristics of said temperature sensor of said replacement recording head by processing the presumed characteristics.

4. An apparatus as set forth in claim 3, wherein said correcting means corrects the value based on the output value of said temperature sensor by using detected characteristics detected by said detecting means.

5. An apparatus as set forth in claim 1, further comprising an environment sensor for detecting an ambient temperature of said recording apparatus, said environment sensor for detecting the temperature independently of said temperature sensor of said replacement head.

6. An apparatus as set forth in claim 5, wherein said presuming means presumes characteristics of said temperature sensor on a basis of temperature changes of said recording head detected by said temperature sensor in a fixed time and an ambient temperature detected by said environment sensor.

7. An apparatus as set forth in claim 6, wherein said recording head comprises a plurality of head portions which are integrated.

8. An apparatus as set forth in claim 7, wherein said temperature sensor comprises a plurality of temperature sensors and each of said plurality of head portions has one of said temperature sensors mounted thereon, and said presuming means uses an average value of the temperature change of each said head portion detected by said plurality of temperature sensors as a temperature change of said recording head.

9. An apparatus as set forth in claim 7, further comprising means for supplying plural different color inks to said recording head, wherein each of said plurality of head portions performs recording with a different color.

10. An apparatus as set forth in claim 6, wherein said presuming means causes a detecting operation of a temperature change of said recording head to be effected when a status of said recording apparatus changes during detecting the temperature change of said recording head.

11. An apparatus as set forth in claim 6, further comprising an indicating portion interconnected with said presuming means for indicating a status of said recording apparatus.

12. An apparatus as set forth in claim 11, wherein said indicating portion flickers during operation of said presuming means.

13. An apparatus as set forth in claim 12, wherein said presuming means uses an average value of a temperature change of said recording head in a period as long as a half of a flickering period of said indicating member, as a temperature change of said recording head.

14. An apparatus as set forth in claim 1, wherein said recording head comprises an electrothermal transducer for generating thermal energy to create bubbles in ink to displace and eject the ink.

15. An apparatus as set forth in claim 1, further comprising means for supplying plural different color inks to said recording head, wherein said recording head records with a plurality of colors.

16. An apparatus as set forth in claim 1, wherein said mounting means comprises a carriage on which said recording head is mounted.

17. An apparatus as set forth in claim 1, further comprising feeding means for feeding a recording medium on which said recording head records images.

18. An apparatus as set forth in claim 1, wherein said recording apparatus comprises a copy machine.

19. An apparatus as set forth in claim 1, wherein said recording apparatus comprises a facsimile.

20. An apparatus as set forth in claim 1, wherein said recording apparatus is connected to a computer terminal.

21. A recording method of recording with a recording head mounted in a recording apparatus to record images, said recording head comprising means for generating thermal energy and a temperature sensor for outputting an output value corresponding to detected temperature, said method comprising the steps of:

removably mounting a mounted recording head;

detecting that said mounted recording head has been replaced with a replacement recording head;

presuming characteristics of said temperature sensor on said replacement recording head based on a time-based change of the output value from said temperature sensor when replacement of said mounted recording head is sensed in said detecting step; and correcting a value based on the output value from said temperature sensor by processing data including the presumed characteristics.

22. A method as set forth in claim 21, wherein the value based on the output value of said temperature sensor is corrected by at least initially processing said presumed characteristics in said correcting step.

23. A method as set forth in claim 21, further comprising the step of detecting characteristics of said temperature sensor of said replacement recording head by processing the presumed characteristics.

24. A method as set forth in claim 23, wherein, in said correcting step, the value based on the output value of said temperature sensor is corrected by processing detected characteristics detected in said characteristics detecting step.

25. A method as set forth in claim 24, further comprising the step of detecting an ambient temperature of said recording apparatus independently of said temperature sensor of said replacement head.

26. A method as set forth in claim 25, wherein, in said presuming step, the characteristics of the temperature sensor are presumed on a basis of a temperature change of said recording head detected by said temperature sensor in a fixed time and a detected ambient temperature.

27. A method as set forth in claim 26, wherein said recording head comprises a plurality of head portions being integrated.

28. A method as set forth in claim 27, wherein said temperature sensor comprises a plurality of temperature sensors and each of said plurality of head portions has one of said temperature sensors mounted thereon, and the temperature change of said recording head in said presuming step is an average value of temperature changes of said head portions detected by said plurality of temperature sensors.

29. A method as set forth in claim 27, further comprising the step of supplying plural different color inks to said recording head, wherein each of said plurality of head portions records images with a different color.

30. A method as set forth in claim 26, wherein in the presuming step, a detecting operation is effected for a temperature change of said recording head when a status of said recording apparatus changes during detection of the temperature change of said recording head.

31. A method as set forth in claim 26, further comprising the step of indicating a status of said recording apparatus.

32. A method as set forth in claim 31, wherein, in said indicating step, an indicating member is flickering during execution of said presuming step.

33. A method as set forth in claim 32, wherein in said presuming step, a temperature change of said replacement recording head is an average value of a temperature change of said replacement recording head in a period as long as a half of a flickering period of said indicating member.

34. A method as set forth in claim 21, wherein said recording head comprises an electrothermal transducer for generating thermal energy to create bubbles in ink to displace and eject the ink.

35. A method as set forth in claim 21, further comprising a step of supplying plural different color inks to said recording head, wherein said recording head records with a plurality of colors.

36. A recording apparatus having a recording head for recording, said recording head comprising means for generating thermal energy for recording and a temperature sensor for outputting an output value corresponding to detected temperature, said apparatus comprising:

presuming means for presuming characteristics of the temperature sensor of the recording head based on a time-based change of the output value from the temperature sensor;

correcting means for correcting a value based on the output value from the temperature sensor by processing data including the characteristics presumed by said presuming means; and control means for controlling the recording head based on the value of the temperature sensor as corrected by said correcting means.

37. An apparatus as set forth in claim 36, further comprising a mounting portion for the recording head, wherein presumption by said presuming means is effected when the recording head is mounted in said mounting portion.

38. An apparatus as set forth in claim 36, further comprising an environment sensor for detecting an ambient temperature of said recording apparatus, said environment sensor detecting the temperature independently of the temperature sensor of the recording head and supplying the ambient temperature to said presuming means.

39. An apparatus as set forth in claim 38, wherein said presuming means presumes the characteristics of the temperature sensor based on temperature changes of the recording head detected by the temperature sensor in a fixed time and the ambient temperature detected by said environment sensor.

40. An apparatus as set forth in claim 36, wherein the recording head comprises an electrothermal transducer for generating thermal energy to create bubbles in ink to displace and eject the ink.

41. An apparatus as set forth in claim 36, further comprising feeding means for feeding a recording medium on which the recording head records images.

42. A recording method of recording with a recording head mounted in a recording apparatus to record images, the recording head comprising means for generating thermal energy and a temperature sensor for outputting an output value corresponding to detected temperature, said method comprising the steps of:

presuming characteristics of the temperature sensor of the recording head based on a time-based change of the output value from the temperature sensor;

correcting a value based on the output value from the temperature sensor by processing data including the characteristics presumed in said presuming step; and controlling the recording head to record based on the characteristics of the temperature sensor as corrected in said correction step.

43. A method as set forth in claim 42, further comprising the step of mounting the recording head in a mounting portion, wherein said presuming step is effected when the recording head is mounted in said mounting step.

44. A method as set forth in claim 42, further comprising the step of detecting an ambient temperature of the recording apparatus with an environment sensor, the environment sensor detecting the ambient temperature independently of the temperature sensor of the recording head, wherein the ambient temperature is used in said presuming step.

* * * * *

UNITED STATES PATENT AND TRADEMARK OFFICE

CERTIFICATE OF CORRECTION

PATENT NO. : 6,024,430
DATED : February 15, 2000
INVENTOR(S) : Koitabashi et al.

It is certified that error appears in the above-identified patent and that said Letters Patent is hereby corrected as shown below:

Title page,
Item [56], References Cited, FOREIGN PATENT DOCUMENTS, “05031906” should read -- 5-31906 --, “05031918” should read -- 5-31918 --, and “05064890” should read -- 5-64890 --.

Column 1,
Line 66, “temperatue” should read -- temperature --.

Column 2,
Line 9, “raise” should read -- rise --.
Line 12, “raise” should read -- rise --.
Line 36, “to” should read -- to as --.

Column 6,
Line 18, “exalted” should read -- high --.

Column 9,
Line 2, “rise” should read -- rise per --.
Line 21, “impariably” should be deleted.

Column 12,
Line 1, “discharge” should read -- serve --, and “roll” should read -- role --.

Column 13,
Line 58, “an” should read -- a --.

UNITED STATES PATENT AND TRADEMARK OFFICE

CERTIFICATE OF CORRECTION

PATENT NO. : 6,024,430
DATED : February 15, 2000
INVENTOR(S) : Koitabashi et al.

It is certified that error appears in the above-identified patent and that said Letters Patent is hereby corrected as shown below:

Column 26,
Line 31, "facsimile." should read -- facsimile machine. --.

Signed and Sealed this

Twenty-first Day of January, 2003

JAMES E. ROGAN
*Director of the United States Patent and Trademark Office*